United States Patent [19]

Shiba et al.

[11] Patent Number: 5,057,402

[45] Date of Patent: Oct. 15, 1991

[54] SILVER HALIDE PHOTOGRAPHIC MATERIALS

[75] Inventors: Keisuke Shiba; Kazunori Hasebe; Masahiro Asami, all of Kanagawa, Japan

[73] Assignee: Fuji Photo Film Co., Ltd., Kanagawa, Japan

[21] Appl. No.: 298,444

[22] Filed: Jan. 18, 1989

[30] Foreign Application Priority Data

Jan. 18, 1988 [JP] Japan ..... 63-7861

[51] Int. Cl.[5] ..... G03C 7/16

[52] U.S. Cl. ..... 430/377; 430/567; 430/604; 430/611; 430/551

[58] Field of Search ..... 430/567, 604, 611, 551, 430/377

[56] References Cited

U.S. PATENT DOCUMENTS

| | | | |
|---|---|---|---|
| 3,672,901 | 6/1972 | Ohkubo et al. | 430/569 |
| 4,173,483 | 3/1979 | Habin et al. | 430/575 |
| 4,820,624 | 4/1989 | Hasebe et al. | 430/567 |
| 4,892,803 | 1/1990 | Waki et al. | 430/567 |

FOREIGN PATENT DOCUMENTS

| | | | |
|---|---|---|---|
| 0277589 | 10/1988 | European Pat. Off. | 430/551 |
| 2024003 | 7/1970 | Fed. Rep. of Germany . | |
| 2230214 | 1/1974 | Fed. Rep. of Germany | 430/604 |

OTHER PUBLICATIONS

The Journal of Photographic Science, vol. 11, 1963, pp. 140–144.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material having at least one light-sensitive emulsion layer containing surface latent image type silver halide grains on a support, wherein the emulsion layer contains a silver halide emulsion, in an amount of 50% by weight or more, which is a substantially silver iodide-free silver chlorobromide comprising silver chloride in an amount of 70 mol % or more (as a mean value) of the total silver halide constituting the silver halide grains, which has a silver bromide-localized phase with a silver bromide content of less than 70 mol % in the inside or on the surface of the grains, and which further contains ions on in the grains.

19 Claims, No Drawings

SILVER HALIDE PHOTOGRAPHIC MATERIALS

FIELD OF THE INVENTION

The present invention relates to silver halide photographic materials for forming a latent image mainly on the surface of the silver halide grains and, more precisely, to those which have excellent rapid processability, high sensitivity and high contrast with less reciprocal law failure and which additionally are easy to handle.

BACKGROUND OF THE INVENTION

Various kinds of silver halide photographic materials are now commercially sold and various methods for forming images with the materials are known and are utilized in various fields. The halogen composition constituting the silver halide emulsions used in these many photographic materials is mostly a silver iodobromide, silver chloroiodobromide or silver chlorobromide consisting essentially of silver bromide for the purpose of attaining the high sensitivity.

On the other hand, in the products, such as photographic materials for color printing papers, to be used in the commercial field where an extremely large amount of prints are required to be finished in a short period of time, a substantially silver iodide-free silver bromide or silver chlorobromide is used because of the necessity of accelerating the development speed.

Recently, there has been a need for improving the rapid processability of color printing photographic materials, and various studies have been made thereon. It is well known that by increasing the silver chloride content in the silver halide emulsion to be used in the photographic materials, a remarkable improvement of the developability (rapid development speed) of the materials can be obtained.

However, a silver halide emulsion with a high silver chloride content is known to have some defects in that it is easily fogged, it cannot be given a high sensitivity by conventional chemical sensitization, and it frequently has a reciprocal law failure which means that it shows a large variation of sensitivity and gradation in accordance with exposure intensity.

In order to overcome the above-mentioned defects in the silver halide emulsions with a high silver chloride content, various techniques have been proposed and illustrated.

JP-A-58-95736, JP-A-58-108533 (U.S. Pat. No. 4,564,591) JP-A-60-222845 (U.S. Pat. No. 4,605,610) (the term "JP-A" as used herein refers to a "published unexamined Japanese patent application") mention that various silver halide grain structures having a high silver bromide content layer are effective for overcoming the defects of silver halide emulsions with a high silver chloride content. Introduction of the high silver bromide content layer surely causes various variation of the photographic properties of the resulting silver halide emulsion with a high silver chloride content. However, the effect of improving the reciprocal law failure was only slight even by the above technique.

JP-A-51-139323 and JP-A-59-171947 and British Patent 2,109,576A mention that incorporation of Group VIII metal compounds is effective for elevating the photographic sensitivity and for reducing the reciprocal law failure characteristic. JP-B-49-33781 (the term "JP-B" as used herein refers to an "examined Japanese patent publication"), JP-A-50-23618, JP-A-52-18310, JP-A58-15952, JP-A-59-214028 and JP-A-61-67845, German Patent 2,226,877, German Patent OLS 2,708,466 and U.S. Pat. No. 3,703,584 mention that incorporation of rhodium compounds or iridium compounds is effective for elevating the high contrast and for reducing the reciprocal law failure characteristic. However, these techniques are still insufficient for overcoming the problems in the high silver chloride content silver halide emulsions for use in the present invention. JP-A-62-75436 and JP-A-62-80640 mention use of rhodium compounds for obtaining low sensitive photographic materials capable of being processed in a daylight room. U.S. Pat. No. 3,703,589 mentions use of the above metals in direct positive type silver halide emulsions. JP-B-48-35373 mentions incorporation of water-soluble iron compounds into silver chloride emulsions obtained by a normal mixing method to give a high contrast black-and-white printing photographic materials at a low cost. However, all of these photographic materials were still insufficient in sensitivity, reciprocal law failure characteristic and latent image stability, and the problems in the prior art could not still be overcome up to the present.

SUMMARY OF THE INVENTION

An object of the present invention is to provide a high contrast silver halide photographic material with high sensitivity, and which has excellent rapid processability.

Another object of the present invention is to provide a silver halide photographic material whose sensitivity and gradation are hardly varied by variation of the exposure intensity.

A further object of the present invention is to provide a silver halide photographic material whose sensitivity and gradation are hardly varied by the prolonged time interval between exposure and development.

The above-mentioned objects of the present invention can be attained by provision of a silver halide photographic material having at least one light-sensitive emulsion layer containing surface latent image silver halide grains on a support, wherein the emulsion layer contains substantially silver iodide-free silver chlorobromide grains having a silver chloride content of 70 mol % or more (as a mean value) and further having a silver bromide-localized phase with a silver bromide content of less than 70 mol % in the inside or surface of the grains, and which further contains iron ion in the grains.

DETAILED DESCRIPTION OF THE INVENTION

In accordance with the present invention, the particular silver halide emulsion as defined above is preferably present in one emulsion layer in an amount of at least 50% by weight. More preferably, the amount of the particular silver halide emulsion is 70% by weight or more, and further more preferably 90% by weight or more. The amount (% by weight) means the proportion of the particular silver halide in one emulsion layer, when the layer contains plural kinds of silver halide emulsions in mixture. It is a matter of course that the emulsion layer may contain the particular emulsion as the only emulsion in the layer, as one embodiment of the present invention. (In this case, the amount of the particular emulsion in the layer is 100% by weight.)

The "silver bromide-localized phase" is meant to indicate a part of the grain which has a substantial difference from the other or remaining part (substrate) of the grain with respect to silver bromide content.

The "mean value" of the silver chloride is meant to indicate a mean value of the proportion of silver chloride in the respective grains for the silver halide composition in one silver halide emulsion.

The iron ion donating compound to be used in the present invention is a 2-valent or 3-valent iron ion-containing compound which preferably includes iron salts or iron complexes soluble in water under the condition of the concentration to be employed by the invention. Especially preferred are iron complexes which may easily be introduced into silver halide grains. Specific examples of iron ion donating compounds for use in the present invention are as follows, which, however, are not limitative: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous malate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chromate, ferric citrate, ferric fluoride, ferric formate, ferric glycerophosphate, ferric hydroxide, acid ferric phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexacyanoferrate(II), potassium ferrous pentacyanoammine, sodium ferric ethylenedinitrilotetraacetate, potassium hexacyanoferrate(III), ferric tris(-dipyridyl) chloride, potassium ferric pentacyanonitrosil, and ferric hexaurea chloride.

In particular, hexacyanoferrates(II), hexacyanoferrates(III), ferrous thiocyanates and ferric thiocyanates display an extreme effect.

The aforesaid iron ion donating compound is introduced into the aqueous gelatin solution which is to be a dispersing medium, aqueous halide solution, aqueous silver salt solution or other aqueous solution, during formation of the silver halide grains. In any case, the resulting solution is introduced into the localized phase and/or other grain part (substrate) in the silver halide grains of the present invention. In accordance with the present invention, it is preferred to not incorporate the iron ion in the localized phase, but to incorporate the iron ion in the grain substrate.

The amount of the iron ion donating compound to be added is, in general, from $5\times10^{-9}$ to $1\times10^{-3}$ mol, preferably from $1\times10^{-}$to $5\times10^{-4}$ mol, per mol of the silver halide used. If the amount is too small, the effect will be insufficient, but if it is too large, desensitization or fog will occur.

Regarding the time of incorporating the iron ion into emulsion grains in accordance with the present invention, it is preferred that the iron ion donating compound is added to the reaction system simultaneously with the addition of silver and/or halogen, or immediately before the addition or immediately after the addition.

The localized phase or substrate of the silver halide grains of the present invention can contain additional or different metal ions selected from Group VIII metal ions or complex ions thereof, together with the iron ion-containing compound. For example, the localized phase can contain iridium ions, and the substrate can contain metal ions selected from osmium, iridium, platinum, ruthenium, palladium, cobalt and nickel ions or complex ions thereof in combination. The kind and the concentration of the metal ions to be incorporated into the localized phase and the substrate may be varied. Plural kinds of these metals may be used.

In addition, other metal ions such as cadmium, zinc, lead, mercury or thallium may also be used. Accordingly, silver halide emulsions which are excellent in reducing reciprocal law failure, and which have excellent sensitivity and stability of gradation can be obtained.

The amount of the metal ion or complex ion thereof which may be used together with the iron ion-containing compound is suitably from $5\times10^{-9}$ to $1\times10^{-4}$ mol, preferably from $1\times10^{-8}$ to $1\times10^{-5}$ mol, most preferably from $5\times10^{-8}$ to $5\times10^{-6}$ mol, per mol of silver halide.

These metal ions will be mentioned in more detail. The iridium ion-containing compound is preferably a 3-valent or 4-valent salt or complex salt, the latter being especially preferred. For example, there are preferably halogen salts, halogeno complex salts, ammine complex salts and oxalato complex salts, such as iridous(III) chloride, iridous(III) bromide, iridic(IV) chloride, sodium hexachloroiridate(III), potassium hexachloroiridate(IV), hexaammine iridium(III) chloride, hexaammine iridium(IV) chloride, potassium trioxalatoiridate(III), potassium trioxalatoiridate(IV) and so on. The amount thereof to be used is from $5\times10^{-9}$ to $10^{-4}$ mol, preferably from $5\times10^{-8}$ to $5\times10^{-6}$ mol, per mol of silver.

The platinum ion-containing compound is preferably a 2-valent or 4-valent salt or complex, and the latter is preferred. For example, there are preferably platinum(IV) chloride, potassium hexachloroplatinate(IV), tetrachloroplatinic(II) acid, tetrabromoplatinic(II) acid, sodium tetrakis(thiocyanato)platinate(VI), hexaammineplatinum(IV) chloride and so on. The amount thereof to be used is from to $10^{-5}$ mol or so, per mol of silver.

The palladium ion-containing compound is generally a 2-valent or 4-valent salt or complex, and the latter is especially preferred. For example, there are sodium tetrachloropalladate(II), sodium tetrachloropalladate(IV), potassium hexachloropalladate(IV), tetraammine-palladium(II) chloride, potassium tetracyanopalladate(II) and so on.

The nickel ion-containing compound includes, for example, nickel chloride, nickel bromide, potassium tetrachloronickelate(II), hexaammine-nickel(II) chloride, sodium tetracyanonickelate(II) and so on.

The rhodium ion-containing compound is generally preferably a 3-valent salt or complex. For example, there are potassium hexachlororhodate, sodium hexabromorhodate, ammonium hexachlororhodate, etc. The amount thereof to be used is from to $10^{-8}$ to $10^{-4}$ mol or so, per mol of silver.

The halogen composition of the silver halide grains for use in the present invention must be a substantially silver iodide-free silver chlorobromide where 70 mol % or more, preferably 90 mol % or more, of the total silver halide constituting the silver halide grains is silver chloride. "Substantially silver iodide-free" as referred to herein means that the silver iodide content is 1.0 mol % or less. The especially preferred halogen composition in the silver halide grains of the invention is a substantially silver iodide-free silver chlorobromide in which 95 mol % or more of the total silver halide constituting the silver halide grains is silver chloride.

In addition, the silver halide grains for use in the present invention are required to have a silver bromide-localized phase in which the bromide content is more than 10 mol % and less than 70 mol %. The position of the silver bromide-localized phase may freely be selected in accordance with the object, and this may be either in the inside of the silver halide grains or on the surface or sub-surface thereof. Alternatively, the silver bromide-localized phase may be both in the inside and on the surface or sub-surface of the grain. The localized phase may be either in the form of a layered structure to surround the silver halide grain or in the form of a discrete structure, in the inside or surface of the silver halide grain. As one preferred embodiment of the position of the silver bromide-localized phase, there is an epitaxially grown grain form in which a localized phase having a silver bromide content of more than at least 10 mol %, especially preferably more than 20 mol %, has locally epitaxially grown on the surface of the silver halide grain host.

The silver bromide content in the localized phase is preferably more than 20 mol %, but if the silver bromide content is too high, the resulting photographic material would thereby have some unfavorable characteristics in that the material would easily be desensitized when pressure is imparted thereto, or the sensitivity and gradation of the material would noticeably vary by variation of the composition of the processing solution as applied thereto. In consideration of these points, the silver bromide content in the localized phase is preferably from 20 to 60 mol %, most preferably from 30 to 50 mol %. The other silver halide constituting the localized phase is preferably silver chloride. The silver bromide content in the localized phase can be analyzed by X-ray diffraction method (for example described in *New Experimental Chemistry Lecture* 6, Structure Analysis, edited by Japan Chemical Society and published by Maruzen) or XPS method (for example, described in *Surface Analysis*, Application of IMA, Auger Electron and Photoelectron Spectroscopy, published by Kodansha, Japan). The localized phase is preferably comprised of from 0.1 to 20% of silver, more preferably from 0.5 to 7% of silver, of the total silver amount constituting the silver halide grain of the invention.

The silver bromide-localized phase and the other phase may have a distinct phase boundary therebetween, or they may have a short phase transition range where the halogen composition gradually varies, therebetween.

Various methods may be employed to form the silver bromide-localized phase. For instance, a soluble silver salt and soluble halide(s) may be reacted by a double jet method to form the intended localized phase. Further, a so-called conversion method may also be employed to form the localized phase, which includes a step of converting a portion of already prepared silver halide grains into other silver halide composition having a smaller solubility product. Still alternatively, the localized phase may also be formed by adding fine silver bromide grains to already formed silver chloride grains so that the former may be recrystallized out on the surface of the latter.

In the present invention, when an iridium compound is incorporated in silver halide grains together with an iron compound, it is preferred that the localized phase is deposited together with at least 50% of the total iridium which preferably is added during the preparation of silver halide grains.

Codeposition of the localized phase and the iridium ion may be attained by addition of the iridium compound to the grain-forming reaction system, simultaneously with the addition of the silver and/or halogen(s) for formation of the localized phase, or immediately before the addition or immediately after the addition.

The silver halide grains for use in the present invention are required to be chemically sensitized on the surface thereof, in such a degree that the grains are substantially surface latent image type grains. For chemical sensitization, a sulfur sensitization method using an active gelatin or a sulfur-containing compound capable of reacting with silver halide (for example, thiosulfates, thioureas, mercapto compounds, and rhodanines); a reduction sensitization method using a reducing substance (for example, stannous salts, amines, hydrazine derivatives, formamidinesulfinic acid, silane compounds); or a noble metal sensitization method using a noble metal compound (for example, gold complexes and complexes of metals of Group VIII of the Periodic Table, such as Pt, Ir, Pd, Rh or Fe) can be employed singly or in combination. Among these chemical sensitization methods, the sulfur sensitization method is preferred.

The photographic materials having the silver halide grains thus prepared have excellent rapid processability as well as high sensitivity and high contrast with reduced reciprocal law failure, and further have excellent high latent image stability and are easy to handle. These merits of the materials are quite contrary to the common photographic materials made of conventional silver chloride emulsions, and the discovery of photographic materials with such properties is quite surprising.

The silver halide grains for use in the present invention may have (100) plane or (111) plane or both of these planes in the outermost surface thereof. They may also have a higher dimensional plane. Anyway, all of these grains are preferably used in the present invention. Regarding the shape of the silver halide grains for use in the present invention, they may have a regular crystal form such as a cubic, octahedral, dodecahedral or octadecahedral form, or may also have an irregular crystal form such as a spherical form. Further, they may be tabular grains. For example, the emulsion may contain tabular grains having an aspect ratio (length/thickness) of 5 or more, especially 8 or more, in a proportion of 50% or more of the total projected area of the grains therein.

The size of the silver halide grains for use in the present invention may be within the range generally used, but the mean grain size is preferably from 0.1 μm to 1.5 μm. Regarding the grain size distribution, the emulsion may be polydispersed or monodispersed, but it is preferably monodispersed. The grain size distribution to indicate the degree of the monodispersibility of the monodispersed emulsion is represented by the ratio ($s/\bar{d}$) of the statistical standard deviation (s) to the mean grain size ($\bar{d}$) as described in T. H. James, *The Theory of the Photographic Process*, 3rd Ed., The Macmillan Company, New York (1967), p. 39, and the ratio is preferably 0.2 or less, especially preferably 0.15 or less, in the present invention.

Various kinds of compounds can be incorporated into the photographic emulsions for use in the present invention for the purpose of preventing fog during preparation, storage and photographic processing of photographic materials, or for the purpose of stabilizing the photographic property of materials. Precisely, various compounds which are known as an antifoggant or stabilizer can be used for these purposes, which include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole and its derivative where an N-methylureido group is substituted on the m-position of the phenyl group), mercaptopyrimidines and mercaptotriazines; thioketo compounds such as oxazolinethione; azaindenes such as triazaindenes, tetraazaindenes (especially 4-hydroxy-substituted (1,3,3*a*, 7)tetraazaindene) and pentaazaindenes; and benzenethiosulfonic acids, benzenesulfinic acids, benzenesulfonic acid amides, etc.

In particular, mercaptoazoles of the following formula (I), (II) or (III) are preferably added to the coating composition which is used to coat the silver halide emulsion of the present invention onto a support. The amount of the compound to be added is preferably from $1\times10^{-5}$ to $5\times10^{-2}$ mol, especially preferably from $1\times10^{-4}$ to $1\times10^{-2}$ mol, per mol of silver halide.

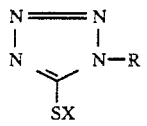

(I)

wherein R represents an alkyl group, an alkenyl group or an aryl group; and X represents a hydrogen atom, an alkali metal atom, an ammonium group or a precursor.

The alkali metal atom includes, for example, a sodium atom and a potassium atom; and the ammonium group includes, for example, a tetramethylammonium group and a trimethylbenzylammonium group. The precursor means a group capable of being a hydrogen or an alkali metal (X=H or alkali metal) under an alkaline condition, which includes, for example, an acetyl group, a cyanoethyl group and a methanesulfonylethyl group.

In the substituent for R, the alkyl group and the alkenyl group may be unsubstituted or substituted, and these may also include cyclic group. As the substituents for the substituted alkyl group, there are a halogen atom, a nitro group, a cyano group, a hydroxyl group, an alkoxy group, an aryl group, an acylamino group, an alkoxycarbonylamino group, a ureido group, an amido group, a heterocyclic group, an acyl group, a sulfamoyl group, a sulfonamido group, a thioureido group, a carbamoyl group, an alkylthio group, an arylthio group, a heterocyclic thio group, as well as a carboxylic acid group, a sulfonic acid group or a salt of the acid group, The above-mentioned ureido group, thioureido group, sulfamoyl group, carbamoyl group and amino group may be unsubstituted or N-alkyl-substituted or N-aryl-substituted. As examples of the aryl group, there are an unsubstituted phenyl group or a substituted phenyl group; and as the substituents for the latter, there are an alkyl group and the above-mentioned substituents for the substituted alkyl group.

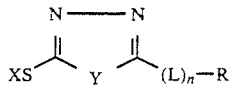

(II)

wherein Y represents an oxygen atom or a sulfur atom; L represents a divalent linking group; and R represents a hydrogen atom, an alkyl group, an alkenyl group or an aryl group.

The alkyl group and alkenyl group for R and the substituent X are the same as those in formula (I).

As specific examples of the divalent linking group for L, there may be mentioned

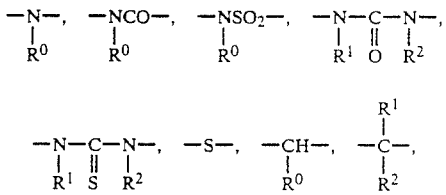

and combinations thereof.

In these examples, n represents 0 or 1; and $R^0$, $R^1$ and $R^2$ each represents a hydrogen atom, an alkyl group or an aralkyl group.

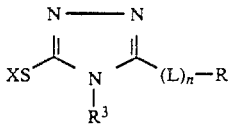

(III)

wherein R and X have the same meaning as in formula (I); L and n have the same meaning as in formula (II); and $R^3$ has the same meaning as R, and $R^3$ and R may be the same or different.

Specific examples of compounds of formulae (I), (II) and (III) are mentioned below, which, however, are not limitative.

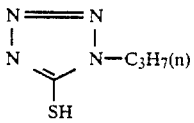

(1)

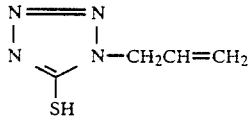

(2)

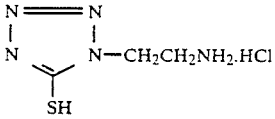

(3)

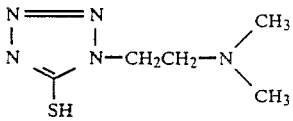

(4)

-continued (5)

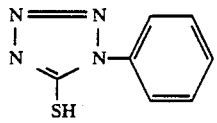

(6)

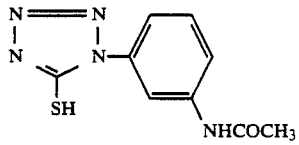

(7)

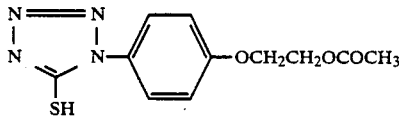

(8)

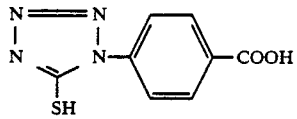

(9)

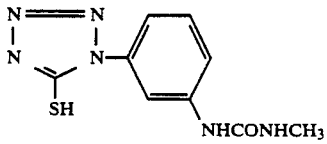

(10)

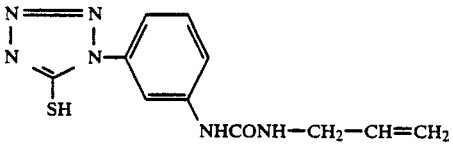

(11)

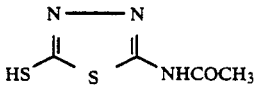

(12)

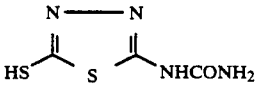

(13)

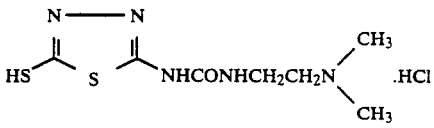

(14)

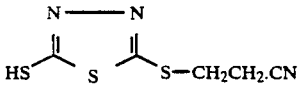

(15)

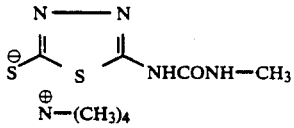

-continued (16)

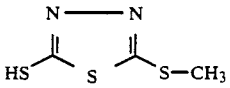

(17)

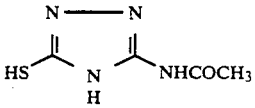

(18)

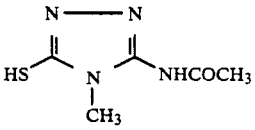

(19)

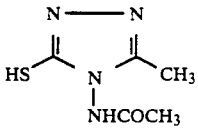

(20)

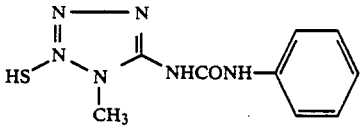

(21)

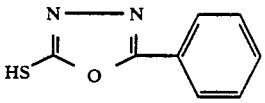

Although the present invention may be applied to black-and-white photographic materials, it is especially preferably applied to multilayer multicolor photographic materials having at least two different color-sensitive layers each with a different spectral sensitivity. Multilayer natural color photographic materials generally have at least one red-sensitive emulsion layer, at least one green-sensitive emulsion layer and at least one blue-sensitive emulsion layer on a support. The order of these layers to be positioned on the support may freely be selected in accordance with the necessity thereof. In general, the red-sensitive emulsion layer contains a cyan-forming coupler, the green-sensitive emulsion layer contains a magenta-forming coupler, and the blue-sensitive emulsion layer contains a yellow-forming coupler. However, any other different combination may also be employed.

As spectral sensitizing dye, methine dyes, such as cyanine dyes or merocyanine dyes, which are generally photographically used can be applied to the photographic materials of the present invention. In particular, cyanine dyes as represented by the following general formula (IV) are especially preferred for use in the present invention. The sensitizing dye may be added during manufacture of the silver halide emulsion for the photographic materials, especially preferably before rinsing of the emulsion or before chemical ripening thereof.

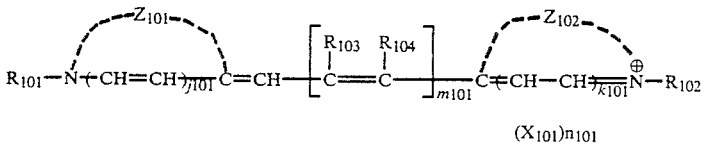

(IV)

wherein $Z_{101}$ and $Z_{102}$ each represents an atomic group necessary for forming a heterocyclic nucleus.

As the heterocyclic nucleus, a 5-membered or 6-membered nucleus having a nitrogen atom and/or another atom such as a sulfur atom, an oxygen atom, a selenium atom or a tellurium atom, as hetero atoms, is preferred, and the ring may optionally be condensed to form a condensed ring or may optionally be substituted to form a substituted ring.

As specific examples of the heterocyclic nuclei, there are thiazole nuclei, benzothiazole nuclei, naphthothiazole nuclei, selenazole nuclei, benzoselenazole nuclei, naphthoselenazole nuclei, oxazole nuclei, benzoxazole nuclei, naphthoxazole nuclei, imidazole nuclei, benzimidazole nuclei, naphthoimidazole nuclei, 4-quinoline nuclei, pyrroline nuclei, pyridine nuclei, tetrazole nuclei, indolenine nuclei, benzindolenine nuclei, indole nuclei, tellurazole nuclei, benzotellurazole nuclei and naphthotellurazole nuclei.

$R_{101}$ and $R_{102}$ each represents an alkyl group, an alkenyl group, an alkynyl group or an aralkyl group. These groups and the groups mentioned below are meant to include substituted groups. Regarding alkyl group as an example, this includes an unsubstituted alkyl group and a substituted alkyl group, and the group may be linear, branched or cyclic. The carbon atom in the alkyl group is preferably from 1 to 8.

As specific examples of the substituents for the substituted alkyl group, there are a halogen atom (e.g., chlorine, bromine, fluorine), a cyano group, an alkoxy group, a substituted or unsubstituted amino group, a carboxylic acid group, a sulfonic acid group and a hydroxyl group. The substituted alkyl group may be substituted by one or more of the above substituents.

As one example of the alkenyl group, there is the vinylmethyl group.

As examples of the aralkyl group, there are the benzyl group and the phenethyl group.

$m_{101}$ represents 0 or a positive integer of 1, 2 or 3. When $m_{101}$ represents 1 $R_{103}$ represents a hydrogen atom, a lower alkyl group, an aralkyl group or an aryl group and $R_{104}$ represents a hydrogen atom, or forms a nitrogen atom-containing heterocyclic ring with $R_{102}$.

As specific examples of the aryl group, there are a substituted phenyl group and an unsubstituted phenyl group.

When $m_{101}$ represents 2 or 3, $R_{103}$ and $R_{104}$ each represents a hydrogen atom, a lower alkyl group or an aralkyl group, or $R_{103}$ forms a hydrocarbon ring or a heterocyclic ring with another $R_{103}$ and $R_{104}$ represents a hydrogen atom, or alternatively $R_{104}$ forms a hydrocarbon ring or a heterocyclic ring with another $R_{104}$ and $R_{103}$ represents a hydrogen atom. Still alternatively $R_{104}$ may form a nitrogen atom-containing heterocyclic ring with $R_{102}$. The above-mentioned rings are preferably a 5-membered or 6-membered ring. $j_{101}$ and $k_{101}$ each represents 0 or 1; $X_{101}$ represents an acid anion; and $n_{101}$ represents 0 or 1.

Among these compounds, those having a reduction potential of −1.23 (VvsSCE) or less are preferred as red sensitizing dyes, and especially those having a reduction potential of −1.27 or less are more preferred. Regarding the chemical structure, benzothiadicarbocyanine dyes in which two methine group in the pentamethine linking group are bonded together to form a ring are preferred. The benzene ring in the benzothiazole nucleus of the dyes is preferably substituted by an electron donating group such as an alkyl group or an alkoxy group.

Measurement of the reduction potential of the compounds can be conducted by phase differentiation type secondary higher harmonics alternate current polarography, in which a mercury drop electrode is used as the working electrode, a saturated calomel electrode as the reference electrode, and a platinum electrode as the counter electrode.

Measurement of reduction potential by phase differentiation type secondary higher harmonics alternate current voltammetry using platinum as the working electrode is described in *Journal of Imaging Science*, Vol. 30, pages 27 to 35 (1986).

Specific examples of red sensitizing dyes for use in the present invention are mentioned below.

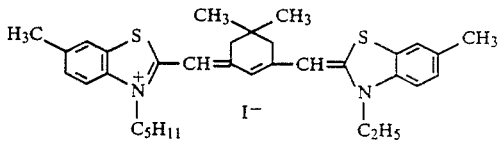

(S-1)

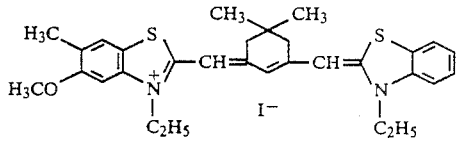

(S-2)

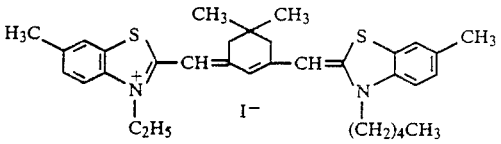

(S-3)

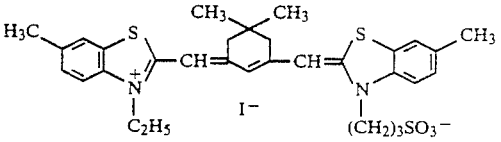

(S-4)

Color photographic materials generally contain a yellow coupler, a magenta coupler and a cyan coupler which are reacted with the oxidation product of an aromatic primary amine developing agent to form yellow, magenta and cyan colors, respectively.

As the yellow coupler for use in the present invention, acylacetamide derivatives such as benzoylacetanilides or pivaloylacetanilides are preferred.

In particular, compounds as represented by the following general formula (Y-1) or (Y-2) are advantageous as the yellow coupler for use in the present invention.

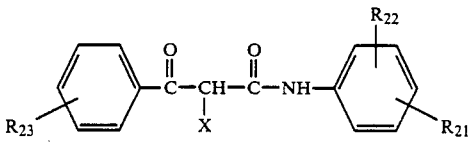

(Y-1)

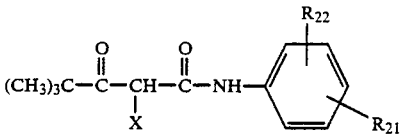

(Y-2)

In these formulae, X represents a hydrogen atom or a coupling-releasing group; $R_{21}$ represents a non-diffusible group having from 8 to 32 carbon atoms in total; $R_{22}$ represents a hydrogen atom or one or more halogen atoms, lower alkyl groups, lower alkoxy groups or nondiffusible groups having from 8 to 32 carbon atoms in total; $R_{23}$ represents a hydrogen atom or a substituent; and when the formula has two or more $R_{23}$'s, they may be the same or different.

The details of pivaloylacetanilide type yellow couplers are described in U.S. Pat. No. 4,622,287, from column 3, line 15 to column 8, line 39, and U.S. Pat. No. 4,623,616, from column 14, line 50 to column 19, line 41.

The details of benzoylacetanilide type yellow couplers are described in U.S. Pat. No. Nos. 3,408,194, 3,933,501, 4,046,575, 4,133,958 and 4,401,752.

As specific examples of pivaloylacetanilide type yellow couplers, there are Compounds (Y-1) to (Y-39) mentioned in the aforesaid U.S. Pat. No. 4,622,287, columns to 54. In particular, Compounds (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

In addition, there are Compounds (Y-1) to (Y-33) mentioned in the aforesaid U.S. Pat. No. 4,623,616, columns 19 to 24; and Compounds (Y-2), (Y-7), (Y-8), (Y-12), (Y-20), (Y-21), (Y-23) and (Y-29) are preferred among them.

Moreover, Compound (34) mentioned in U.S. Pat. No. 3,408,194, column 6; Compounds (16) and (19) mentioned in U.S. Pat. No. 3,933,501; Compound (9) mentioned in U.S. Pat. No. 4,046,575, columns 7 to 8; Compound (1) mentioned in U.S. Pat. No. 4,133,958, columns to 6; Compound (1) mentioned in U.S. Pat. No. 4,401,752, column 5; and the following Compounds (a) to (g) can also preferably be used in the present invention.

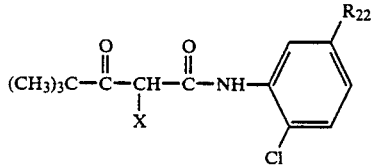

| Compound No. | $R_{22}$ | X |
|---|---|---|
| a | $-COOCH(CH_3)COOC_{12}H_{25}$ | 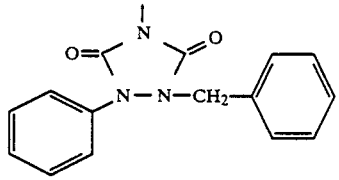 |
| b | $-COOCH(C_4H_9)COOC_{12}H_{25}$ | " |
| c | 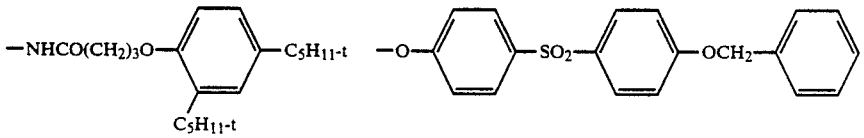 | |
| d | " | 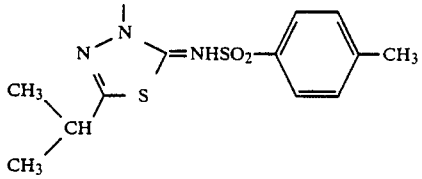 |
| e | " | 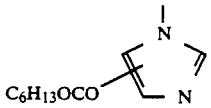 |

-continued

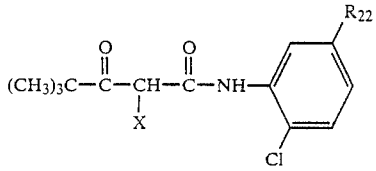

| Compound No. | $R_{22}$ | X |
|---|---|---|
| f | $-NHSO_2C_{12}H_{25}$ | 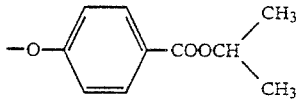 |
| g | $-NHSO_2C_{16}H_{33}$ | 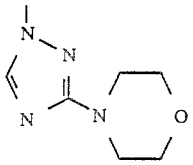 |
| h | $-NHCOCH(CH_3)CH_2SO_2C_{12}H_{25}$ | 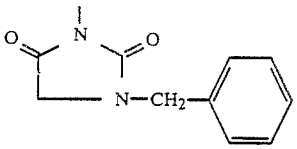 |

Among the above-mentioned couplers, those having a nitrogen atom as the releasing atom are especially preferred.

As magenta couplers which may be used in the present invention, there are oil-protecting indazolone or cyanoacetyl type, preferably 5-pyrazolone or pyrazolotriazole type pyrazoloazole couplers. As the 5-pyrazolone couplers, those in which the 3-position is substituted by an arylamino group or an acylamino group are preferred because of the excellent color hue and the color density of the dyes formed therefrom. Specific examples of the couplers are described in U.S. Pat. Nos. 2,311,082, 2,343,703, 3,600,788, 2,908,573, 3,062,653, 3,152,896 and 3,936,015. As the releasing group for the 2-equivalent 5-pyrazolone couplers, the nitrogen atom-releasing group described in U.S. Pat. No. 4,310,619 and the arylthio group described in U.S. Pat. No. 4,351,897 are preferred. The ballast group-containing 5-pyrazolone couplers described in European Patent 73,636 are preferred as forming dyes with high color density.

As pyrazoloazole couplers for use in the present invention, there are the pyrazolo[5,1-c][1,2,4]-triazoles described in U.S. Pat. No. 3,725,067; the pyrazolotetrazoles described in *Research Disclosure,* Item 24220 (June, 1984); and the pyrazolopyrazoles described in *Research Disclosure,* Item 24230 (June, 1984). All the above-mentioned polymers may be in the form of polymer couplers.

These compounds are concretely represented by the following general formula (M-1), (M-2) or (M-3).

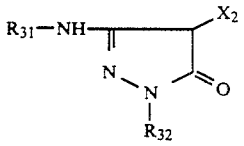

(M-1)

-continued

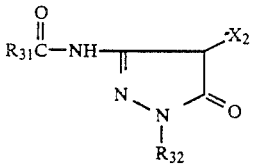

(M-2)

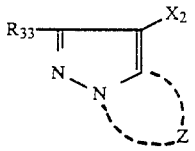

(M-3)

In these formulae, $R_{31}$ represents a non-diffusible group having from 8 to 32 carbon atoms in all; $R_{32}$ represents a phenyl group or a substituted phenyl group; $R_{33}$ represents a hydrogen atom or a substituent; Z represents a nonmetallic atomic group necessary for forming a 5-membered azole ring having from 2 to 4 nitrogen atoms, and the azole ring may have substituent(s) or may have condensed ring(s); and $X_2$ represents a hydrogen atom or a releasing group.

The details of the substituents for $R_{33}$ and the substituents for the azole ring are described in, for example, U.S. Pat. No. 4,540,654, from column 2, line 41 to column 8,line 27.

Among the pyrazoloazole couplers, the imidazo[1,2-b]pyrazoles described in U.S. Pat. No. 4,500,630 are preferred in view of the small yellow side absorption and the high light fastness; and the pyrazolo[1,5-b][1,2,4]triazoles described in U.S. Pat. No. 4,540,654 are especially preferred.

In addition, the pyrazolotriazole couplers in which a branched alkyl group is directly bonded to the 2-, 3- or 6-position of the pyrazolotriazole ring, described in JP-A-61-65245; the pyrazoloazole couplers having a sulfonamido group in the molecule, described in JP-A-61-65246; the pyrazoloazole couplers having an alkoxyphenylsulfonamido ballast group, described in JP-A-61-147254; and the pyrazolotriazole couplers having an alkoxy group or an aryloxy group at the 6-position, described in European Patent (Laid-Open) No. 226849 are also preferably used.

Specific examples of these couplers are mentioned below with reference to formulae (N-I) and (N-II).

| Compound No. | $R_{33}$ | $R_{34}$ | $X_2$ |
|---|---|---|---|
| | 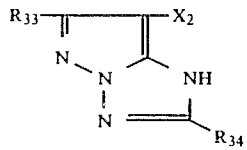 | | (N-I) |
| N-1 | $CH_3-$ | 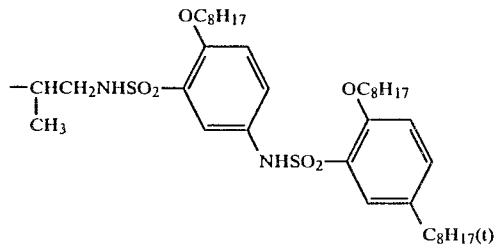 | Cl |
| N-2 | " | 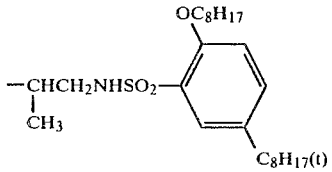 | " |
| N-3 | " | 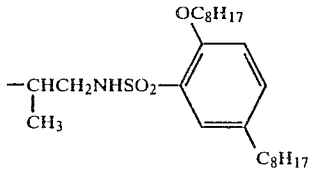 | 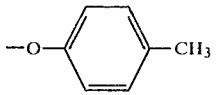 |
| N-4 | 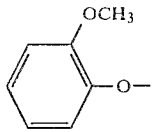 | 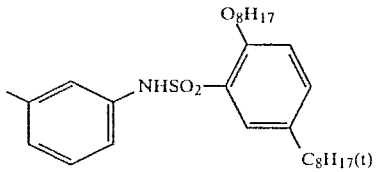 | 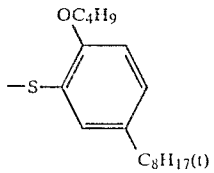 |

-continued
| Compound No. | $R_{33}$ | $R_{34}$ | $X_2$ |
|---|---|---|---|
| N-5 | $CH_3$— | 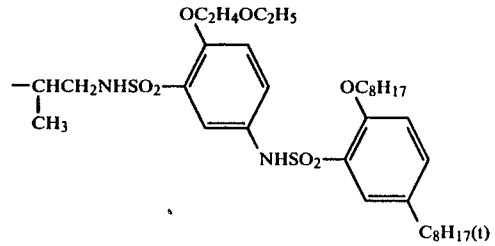 | Cl |
| N-6 | " | 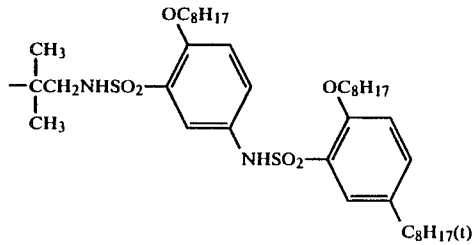 | " |
| N-7 | 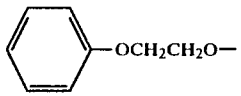 | 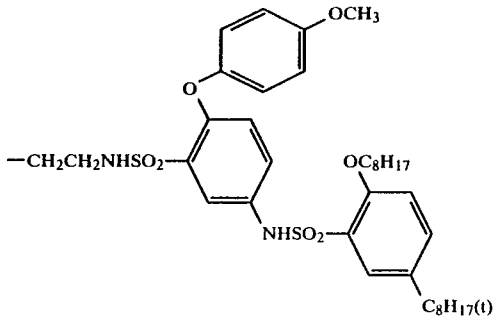 | 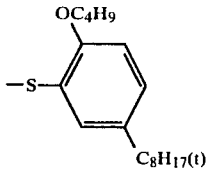 |
| N-8 | $CH_2CH_2O$— | " | " |

-continued
| Compound No. | $R_{33}$ | $R_{34}$ | $X_2$ |
|---|---|---|---|
| N-9 | 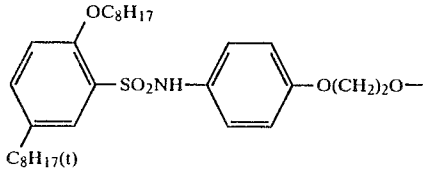 | 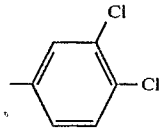 | " |
| N-10 | 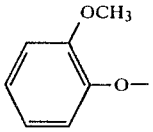 | 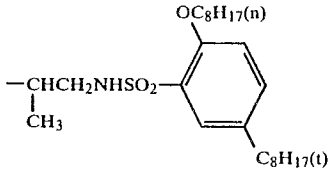 | Cl |
| | 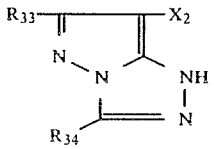 | | (N-II) |
| N-11 | $CH_3$— | 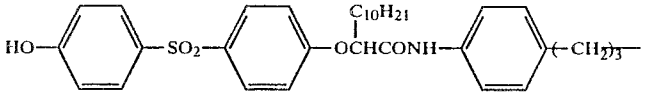 | Cl |
| N-12 | " | 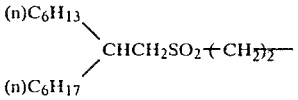 | " |
| N-13 | 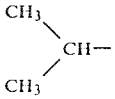 | 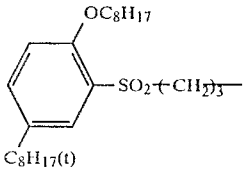 | " |

-continued
| Compound No. | $R_{33}$ | $R_{34}$ | $X_2$ |
|---|---|---|---|
| N-14 | $\leftarrow CH(COOCH_2CH_2OCH_3)-CH_2\rightarrow_{50}\leftarrow CH_2-C(CH_3)(CONH-)\rightarrow_{50}$ | $CH_3-CH(CH_2NHSO_2CH_3)-$ | " |
| N-15 | 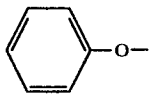 | 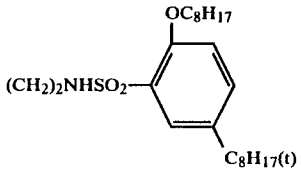 | Cl |
| N-16 | 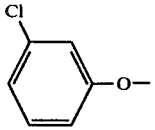 | 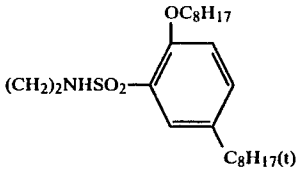 | 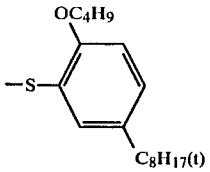 |

As cyan couplers for use in the present invention, phenol cyan couplers and naphthol cyan couplers are most typical.

As examples of phenol cyan couplers, there are mentioned those having an acylamino group in the 2-position of the phenol nucleus and an alkyl group in the 5-position thereof (including polymer couplers) described in U.S. Pat. Nos. 2,369,929, 4,518,687, 4,511,647 and 3,772,002, and the specific examples thereof are the coupler described in Example 2 of Canadian Patent 625,822, Compound (1) described in U.S. Pat. No. 3,772,002, Compounds (I-4) and (I-5) described in U.S. Pat. No. 4,564,590, Compounds (1), (2), (3) and (24) described in JP-A-61-39045 and Compound (C-2) described in JP-A-62-70846.

As still further examples of phenol cyan couplers, there are mentioned the 2,5-diacylaminophenol couplers described in U.S. Pat. Nos. 2,772,162, 2,895,826, 4,334,011 and 4,500,653 and JP-A-59-164555, and specific examples thereof are Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396 and Compound (I-19) described in U.S. Pat. No. 4,613,564.

As still further examples of phenol cyan couplers, there are also mentioned those having a nitrogen-containing hetero ring-condensed phenol nucleus described in U.S. Pat. Nos. 4,372,173, 4,564,586 and 4,430,423, JP-A-61-390441 and Japanese Patent Application No. 61-100222, and specific examples thereof are Couplers (1) and (3) described in U.S. Pat. No. 4,327,173, Compounds (3) and (16) described in U.S. Pat. No. 4,564,586, Compounds (1) and (3) described in U.S. Pat. No. 4,430,423 and the compounds mentioned below.

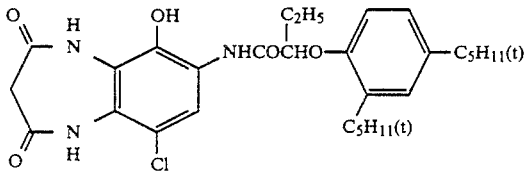

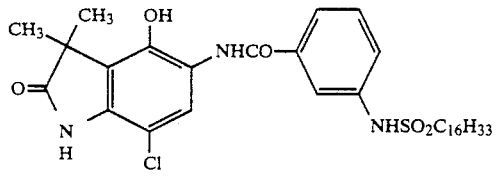

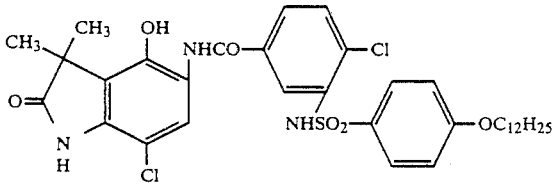

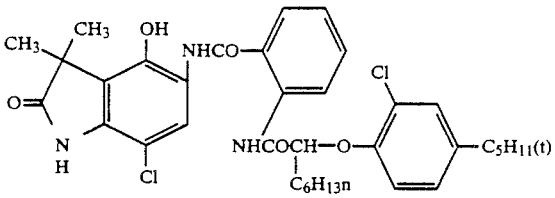

-continued

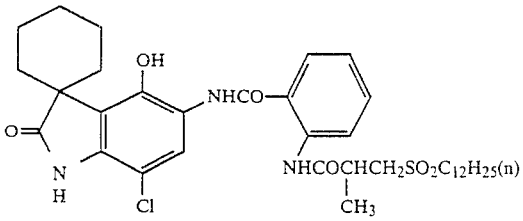

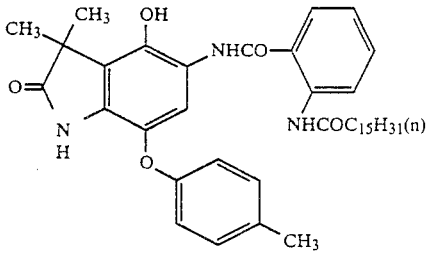

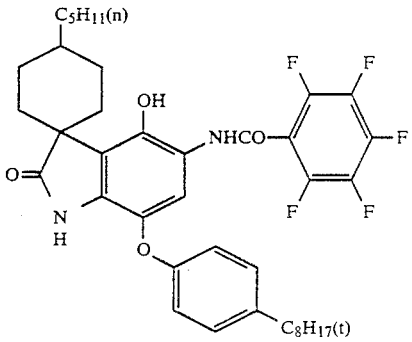

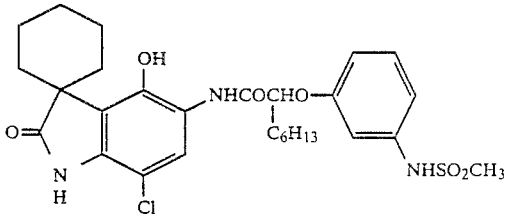

As still further examples of phenol cyan couplers for use in the present invention, there are also mentioned the ureido couplers described in U.S. Pat. Nos. 4,333,999, 4,451,559, 4,444,872, 4,427,767 and 4,579,813 and European Patent (EP) 067,689B1, and specific examples thereof are Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1 and Coupler (3) described in JP-A-61-42658.

As examples of naphthol cyan couplers for use in the present invention, there are mentioned those having an N-alkyl-N-arylcarbamoyl group in the 2-position of the naphthol nucleus (for example, described in U.S. Pat. No. 2,313,586), those having an alkylcarbamoyl group at the 2-position of the naphthol nucleus (for example, described in U.S. Pat. Nos. 2,474,293 and 4,282,312), those having an arylcarbamoyl group in the 2-position of the naphthol nucleus (for example, described in JP-B-50-14523), those described in a carbonamido group in the 5-position of the naphthol nucleus (for example, described in JP-A-60-237448, JP-A-61-145557 and JP-A-61-153640), those having an aryloxy-releasing group (for example, described in U.S. Pat. No. 3,476,563), those having a substituted alkoxy-releasing group (for example, described in U.S. Pat. No. 4,296,199) and those having a glycol acid-releasing group (for example, described in JP-B-60-39217).

The photographic materials of the present invention can contain, as a color-fogging inhibitor, hydroquinone derivatives, aminophenol derivatives, gallic acid derivatives, ascorbic acid derivatives, etc.

The photographic materials of the present invention can also contain various kinds of antifading agents. For example, as typical examples of organic antifading agents for cyan, magenta and/or yellow images, there are hindered phenols such as hydroquinones, 6-hydroxychromans, 5-hydroxycoumarans, spirochromans, p-alkoxyphenols and bisphenols, as well as gallic acid derivatives, methylenedioxybenzenes, aminophenols and hindered amines and ether or ester derivatives thereof formed by silylating or alkylating the phenolic hydroxyl group of the above compounds. In addition, metal complexes such as (bis-salicylaldoximato)nickel complexes and (bis-N,N-dialkyldithiocarbamato)nickel complexes may also be used.

Examples of organic antifading agents which may be used in the present invention are described in the following patent publications.

Hydroquinones are described in U.S. Pat. Nos. 2,360,290, 2,418,613, 2,700,453, 2,701,197, 2,728,659, 2,732,300, 2,735,765, 3,982,944 and 4,430,425, British patent 1,363,921 and U.S. Pat. Nos. 2,710,801 and 2,816,028; 6-hydroxychromans, 5-hydroxycoumarans and spirochromans in U.S. Pat. Nos. 3,432,300, 3,573,050, 3,574,627, 3,698,909 and 3,764,337 and JP-A-52-152225; spiroindanes in U.S. Pat. No. 4,360,589; p-alkoxyphenols in U.S. Pat. No. 2,735,765, British patent 2,066,975, JP-A-59-10539 and JP-B-57-19765; hindered phenols in U.S. Pat. No. 3,700,455, JP-A-52-72224, U.S. Pat. No. 4,228,235 and JP-B-52-6623; gallic acid derivatives, methylenedioxybenzenes and aminophenols in U.S. Pat. Nos. 3,457,079 and 4,332,886 and JP-B-56-21144, respectively; hindered amines in U.S. Pat. Nos. 3,336,135 and 4,268,593, British Patents 1,326,889, 1,354,313 and 1,410,846, JP-B-51-1420 and JP-A-58-114036, JP-A-59-53846 and JP-A-59-78344; phenolic hydroxyl group-etherified or esterified derivatives in U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990 and JP-B-53-3263; and metal complexes in U.S. Pat. Nos. 4,050,938 and 4,241,155 and British Patent 2,027,731(A). These compounds may be added to the intended light-sensitive layer by coemulsifying with the corresponding color coupler in an amount of, generally, from 5 to 100% by weight of the coupler, to improve the dye stability, that is, to prevent color fading. In order to prevent deterioration of cyan color images because of heat and, especially, light, it is more effective to incorporate an ultraviolet absorbent into both of the two layers adjacent to the cyan-coloring layer of the photographic material.

Among the above-mentioned antifading agents, spiroindanes and hindered amines are especially preferred.

In accordance with the present invention, the following compounds are preferably used together with the above-mentioned couplers, especially with pyrazoloazole couplers.

Precisely, compounds (A) capable of chemically bonding with the aromatic amine color developing agent which remains after color development to form a chemically inactive and substantially colorless compound and/or compounds (B) capable of chemically bonding with the oxidation product of the aromatic amine color developing agent which remains after color development to form a chemically inactive and substantially colorless compound are preferably used simultaneously or singly, for example, for the purpose of preventing formation of stains and other harmful side effects which would be caused by the formation of color dyes by reaction of the color developing agent or the oxidation product therefrom which remains in the film of the photographic material and the coupler therein during storage of the material after being processed.

As preferred examples of such compounds (A), there may be mentioned compounds which react with p-anisidine at a secondary reaction rate constant (k2) (in trioctyl phosphate at 80° C.) of from 1.0 liter/mol·sec to $1\times10^{-5}$ liter/mol·sec. The secondary reaction rate constant can be measured by a method described in JP-A-63-158545.

If the constant (k2) is larger than the above range, the compounds themselves would be instable and would often be decomposed by reaction thereof with gelatin or water. On the other hand, if the constant (k2) is smaller than the above range, the reaction speed with the remaining aromatic amine developing agent would be too small and, as a result, the compounds could not attain the intended object of the present invention to prevent the side effect of the remaining aromatic amine developing agent.

Specific examples of such compounds (A) which are preferably used in the present invention are represented by the following general formulae (AI) and (AII).

$$R_1-(A)_n-X \qquad \text{(AI)}$$

$$R_2-\underset{\underset{B}{|}}{C}=Y \qquad \text{(AII)}$$

In these formulae, $R_1$ and $R_2$ each represents an aliphatic group, an aromatic group or a heterocyclic group; n represents 1 or 0; A represents a group that can react with the aromatic amine developing agent to form a chemical bond; X represents a group that can react with the aromatic amine developing agent to split off B represents a hydrogen atom, an aliphatic group, an aromatic group, a heterocyclic group, an acyl group or a sulfonyl group; Y represents a group that can facilitate the addition of the aromatic amine developing agent to the compound having formula (AII); and $R_1$ and X together or Y and $R_2$ or B together may combine to form a ring structure.

Of ways wherein the remaining aromatic amine developing agent and the compound (A) chemically combine, typical ways are substitution reactions and addition reactions.

The preferred examples of the compounds represented by formula (AI) or (AII) include the compounds as described in JP-A-63-158545, JP-A-62-283338, Japanese Patent Application No. 62-158342, EP-A-277589, etc.

More preferred examples of the compounds (B) that can chemically combine with the oxidation product of the aromatic amine developing agent remaining after the color development processing to from a chemically inactive and substantially colorless compound are those represented by the following formula (BI):

$$R—Z \quad (BI)$$

wherein R represents an aliphatic group, an aromatic group, or a heterocyclic group, and Z represents a nucleophilic group or a group that can decompose in the photographic material to release a nucleophilic group. In the compounds represented by the formula (BI), Z preferably represents a group having a Pearson's nucleophilic $nCH_3I$ value (R. G. Pearson et al., *J. Am. Chem. Soc.*, 90, 319 (1968)) of 5 or more, or the group derived therefrom.

The preferred examples of the compounds represented by the formula (BI) include the compounds as described in EP-A-255722, EP-A-277589, JP-A-62-143048, JP-A-62-229145, Japanese Patent Application Nos. 63-136724, 62-214681 and 62-158342, etc.

The detailed explanation on combination of the aforementioned compound (A) and compound (B) is described in EP 277589.

The photographic materials of the present invention can contain an ultraviolet absorbent in the hydrophilic colloid layer. For instance, aryl group-substituted benzotriazoles (for example, those described in U.S. Pat. No. 3,533,794), 4-thiazolidone compounds (for example those described in U.S. Pat. Nos. 3,314,794, 3,352,6810, benzophenone compounds (for example those described in JP-A-46-2784), cinnamic acid ester compounds (for example, those described in U.S. Pat. Nos. 3,705,805, 3,707,375, butadiene compounds (for example, those described in U.S. Pat. No. 4,045,229) or benzoxidol compounds (for example, those described in U.S. Pat. No. 3,700,455) can be used for this purpose. In addition, ultraviolet-absorbing couplers (for example, α-naphthol cyan dye-forming couplers) and ultraviolet-absorbing polymers may also be used. These ultraviolet absorbents may be mordanted in a particular layer.

The photographic materials of the present invention can contain water-soluble dyes in the hydrophilic colloid layer as a filter dye or for the purpose of antiirradiation or for other various purposes. These dyes include oxonol dyes, hemioxonol dyes, styryl dyes, merocyanine dyes, cyanine dyes and azo dyes. In particular, oxonol dyes, hemioxonol dyes and merocyanine dyes are especially advantageous among them.

As the binder or protective colloid to be used in the emulsion layer of the photographic material of the present invention, gelatin is advantageously used. Any other hydrophilic colloid may also be used singly or together with gelatin.

The gelatin for use in the present invention may be either a lime-processed one or an acid-processed one. The details of preparation of gelatins for use in the present invention are described in Arther Vais, *The Macromolecular Chemistry of Gelatin* (published by Academic Press, 1964).

The support for use in the present invention can be a cellulose nitrate film which is generally used in conventional photographic materials, or a transparent film to which a pigment such as titanium oxide has been added, or a plastic film as surface-treated by the method mentioned in JP-B-47-19068. The support is generally coated with a subbing layer. In order to further improve the adhesibility, the surface of the support may be pretreated by corona discharge, ultraviolet irradiation or flame treatment.

Further, a reflective support can also be used in the present invention, which improves the reflectivity of the light-sensitive material so that a dye image formed on the silver halide emulsion layer is made sharp. Examples of such a reflective support include a support coated with a hydrophobic resin comprising a reflective substance such as titanium oxide, zinc oxide, calcium carbonate or calcium sulfate dispersed therein and a vinyl chloride resin comprising a reflective substance. dispersed therein. Specific examples of such supports include baryta paper, polyethylene-coated paper, polypropylene synthetic paper, and transparent support such as glass plate, polyester film (e.g., polyethylene terephthalate, cellulose triacetate, cellulose nitrate), polyamide film, polycarbonate film, and polystyrene film combined with a reflective layer or a reflective substance. These supports can be properly selected depending on the purpose of application.

The present invention may apply to general color photographic materials, especially preferably to printing color photographic materials.

For development of the photographic materials of the present invention, black-and-white developers and/or color developers can be employed. The color developer for use in the present invention is preferably an aqueous alkaline solution consisting essentially of an aromatic primary amine color developing agent. As the color developing agent for the developer, p-phenylenediamine compounds are preferably used, although aminophenol compounds also are useful. Specific examples of the compounds include 3-methyl-4-amino-N,N-diethylaniline, 3-methyl-4-amino-N-ethyl-N-β-hydroxyethylaniline, 3-methyl-4-amino-N-ethyl-β-methanesulfonamidoethylaniline, 3-methyl-4-amino-N-ethyl-N-β-methoxyethylaniline and sulfates, hydrochlorides and p-toluenesulfonates thereof. Two or more of these compounds may be used in combination, in accordance with the object thereof.

The color developer generally contains a pH buffer such as alkali metal carbonates, borates or phosphates, and a development inhibitor or an antifoggant such as bromides, iodides, benzimidazoles, benzothiazoles or mercapto compounds. In addition, the color developer may further contain, if desired, various kinds of preservatives, such as hydroxylamine, diethylhydroxylamine, sulfates, hydrazines, phenylsemicarbazides, triethanolamine, catecholsulfonic acids, triethylenediamine(1,4-diazabicyclo[2,2,2]octanes); an organic solvent such as ethylene glycol or diethylene glycol; a development accelerator such as benzyl alcohol, polyethylene glycol, quaternary ammonium salts or amines; a dye-forming coupler; a competing coupler; a foggant such as sodium boronhydride; an auxiliary developing agent such as 1-phenyl-3-pyrazolidone; a tackifier; as well as various kinds of chelating agents such as aminopolycarboxylic acids, aminopolyphosphonic acids, alkylphosphonic acids or phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine- N,N,N',N'-tetramethylenephosphonic acid, ethylenediaminedi(o-hydroxyphenylacetic acid) and salts thereof.

When reversal processing is carried out, the photographic materials are first subjected to black-and-white development and then to color development. The black-and-white developer to be used in the black-and-white development may contain known black-and-white developing agents, for example, hydroxybenzenes such as hydroquinone, 3-pyrazolidones such as 1-phenyl-3-pyrazolidone or aminophenols such as N-methyl-p-aminophenol, singly or in combination thereof.

The color developer and black-and-white developer generally have a pH value of from 9 to 12. The amount of the replenisher which can be added to the developer is, although depending upon the color photographic materials to be processed, generally 3 liters or less per $m^2$ of the material. By lowering the bromide ion concentration in the replenisher, the amount may be 500 ml or lower. When the amount of the replenisher to be added is lowered, it is desired to prevent the evaporation and aerial oxidation of the processing solution by reducing the contact surface area of the processing tank with air. In addition, the amount of the replenisher to be added may also be reduced by means of suppressing accumulation of bromide ion in the developer.

After being color developed, the photographic emulsion layer is generally bleached. Bleaching may be carried out simultaneously with fixation (bleach fixation) or separately from the latter. In order to accelerate the photographic processing, bleaching may be followed by bleach fixation. In addition, bleach fixation in two continuous processing tanks, fixation prior to bleach fixation or bleach fixation followed by bleaching may also be applied to the photographic materials of the present invention, in accordance with the object thereof. As the bleaching agent there can be used, for example, compounds of polyvalent metals such as iron(III), cobalt(III), chromium(VI) or copper(II), as well as peracids, quinones and nitro compounds. Specific examples of the bleaching agent include ferricyanides; bichromates; organic complexes of iron(III) or cobalt(III), for example, complexes with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycoletherdiaminetetraacetic acid, as well as with citric acid, tartaric acid or malic acid; persulfates; bromates; permanganates; and nitrobenzenes. Among them, aminopolycarboxylic acid/iron(III) complexes such as ethylenediaminetetraacetic acid/iron(III) complex as well as persulfates are preferred in view of the rapid processability thereof and of preventing environmental pollution. The aminopolycarboxylic acid/iron(III) complexes are especially useful both in a bleaching solution and in a bleach fixing solution. The bleaching solution or bleach fixing solution containing such aminopolycarboxylic acid/iron(III) complexes generally has a pH value of from 5.5 to 8, but the solution may have a lower pH value for rapid processing.

The bleaching solution, bleach fixing solution and the previous bath may contain a bleaching accelerating agent, if desired. Various bleaching accelerating agents are known, and examples of the agents which are advantageously used in the present invention include the mercapto group or disulfide group-containing compounds described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426 and *Research Disclosure*, Item 17129 (July, 1978); the thiazolidine derivatives described in JP-A-50-140129; the thiourea derivatives described in JP-B-45-8506, JP-A-52-20832 and JP-A-53-32735 and U.S. Pat. No. 3,706,561; the iodides described in West German Patent 1,127,715 and JP-A-58-16235; the polyoxyethylene compounds described in West German Patents 966,410 and 2,748,430; the polyamine compounds described in JP-B-45-8836; the compounds described in JP-A-49-42434, JP-A-49-59644, JP-A-53-94927, JP-A-54-35727, JP-A-55-26506 and JP-A-58-163940; and bromide ion. Among them, the mercapto group or disulfido group-containing compounds are preferred because of the high accelerating effect thereof, and in particular, the compounds described in U.S. Pat. No. 3,893,858, West German Patent 1,290,812 and JP-A-53-95630 are especially preferred. In addition, the compounds described in U.S. Pat. No. 4,552,834 are also preferred. These bleaching accelerating agents may also be added to photographic materials. When the color photographic materials are bleach-fixed, the bleaching accelerating agents are especially effective.

As the fixing agent, there are mentioned thiosulfates, thiocyanates, thioether compounds, thioureas and a large amount of iodides. Among them, thiosulfates are generally used, and in particular, ammonium thiosulfate is most widely used. As the preservative for the bleach fixing solution, sulfites, bisulfites and carbonyl-bisulfite adducts are preferred.

The silver halide color photographic materials are generally rinsed in water and/or stabilized, after being desilvered. The amount of the water to be used in the rinsing step can be set in a broad range, in accordance with the characteristic of the photographic material being processed (for example, depending upon the raw material components, such as coupler and so on) or the use of the material, as well as the temperature of the rinsing water, the number of the rinsing tanks (the number of the rinsing stages), the replenishment system of normal current or countercurrent and other various kinds of conditions. Among the various conditions, the relation between the number of the rinsing tanks and the amount of the rinsing water in a multistage countercurrent rinsing system can be obtained by the method described in *Journal of the Society of Motion Picture and Television Engineers*, Vol. 64, pages 248 to 253 (May, 1955).

According to the multistage countercurrent system described in the above literature, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material which is being processed. Accordingly, such a system would often have a problem. In the practice of processing the photographic materials of the present invention, the method of reducing calcium and magnesium ions, which is described in JP-A-62-288838, can extremely effectively be used for overcoming the above problem. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* edited by Sankyo Shuppan K. K., Japan (1986), and *Bactericidal and Fungicidal Techniques to Microorganisms,* edited by Association of Sanitary Technique, Japan (1982), and *Encyclopedia of Bactericidal and Fungicidal Agents,* edited by Nippon Bactericide and Fungicide Association (1986) can also be used.

The pH value of the rinsing water which can be used for processing the photographic materials of the present invention is preferably from 4 to 9, more preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, for example, as described in JP-A-57-8543, JP-A-58-14834 and JP-A-60-220345, can be employed.

In addition, the material can also be stabilized, following the rinsing step. As one example thereof, there may be mentioned a stabilizing bath containing formalin and a surfactant, which is used as a final bath for picture-taking color photographic materials. The stabilizing bath may also contain various chelating agents and fungicides.

The overflow from the rinsing and/or stabilizing solutions because of addition of replenishers thereto may be reused in the other steps such as the desilvering step.

The silver halide photographic materials of the present invention can contain a color developing agent for the purpose of simplifying and accelerating the processing of the materials. For incorporation of color developing agents into the photographic materials, various precursors of the agents are preferably used. For example, there are mentioned the indoaniline compounds described in U.S. Pat. No. 3,342,597, the Schiff base compounds described in U.S. Pat. No. 3,342,599 and *Research Disclosure,* Item 14850 (Vol. 148, 1976) and 15159 (Vol. 151, 1976), the aldol compounds described in *Research Disclosure,* Item 13924 (Vol. 139, 1975), the metal complexes described in U.S. Pat. No. 3,719,492 and the urethane compounds described in JP-A-53-135628, as the precursors.

The silver halide color photographic materials of the present invention can contain various kinds of 1-phenyl-3-pyrazolidones, if desired, for the purpose of accelerating the color developability thereof. Specific examples of the compounds are described in JP-A-56-64339, JP-A-57-144547 and JP-A-58-115438.

The processing solutions for the photographic materials of the invention are used at 10° C. to 50° C. In general, a processing temperature of from 35° C. to 38° C. is standard, but the temperature may be made higher so as to accelerate the processing or to shorten the processing time, or on the contrary, the temperature may be made lower so as to improve the quality of images formed and to improve the stability of the processing solutions used. For the purpose of economization of silver in the photographic materials, the cobalt intensification or hydrogen peroxide intensification described in West German Patent 2,226,770 and U.S. Pat. No. 3,674,499 may be employed in processing the photographic materials of the invention.

In order to sufficiently display the excellent characteristics of the silver halide photographic materials of the present invention, it is preferred that the silver halide color photographic material having at least one light-sensitive layer which contains the particular silver halide grains as defined in the present invention and at least one coupler capable of forming a dye by coupling reaction with the oxidation product of an aromatic primary amine color developing agent, on a reflective support, is processed with a color developer which does not substantially contain benzyl alcohol and which contains a bromide ion in an amount of 0.002 mol/liter or less for a developing period of 2 minutes an 30 seconds or less.

The color developer "which does not substantially contain benzyl alcohol" as referred to hereinabove means that the content of benzyl alcohol in the developer is 2 ml or less, preferably 0.5 ml or less, per liter of the color developer, and most preferably, the color developer contains no benzyl alcohol.

The following examples are intended to illustrate the present invention in more detail but not to limit it in any way.

EXAMPLE 1

6.4 g of sodium chloride was added to an aqueous 3 wt % solution of lime-processed gelatin, and 3.2 ml of N,N'-dimethylimidazolidine-2-thione (aqueous 1 wt % solution) was added thereto. An aqueous solution containing 0.2 mol of silver nitrate and a first aqueous alkali halide solution containing 0.08 mol of potassium bromide and 0.12 mol of sodium chloride were added to the resulting solution with vigorous stirring at 52° C. and then blended. Subsequently, an aqueous solution containing 0.8 mol of silver nitrate and a second aqueous alkali halide solution containing 0.32 mol of potassium bromide and 0.48 mol of sodium chloride were further added thereto also with vigorous stirring at 52° C. and then blended. One minute after the completion of the addition of the aqueous silver nitrate solution and the second aqueous alkali halide solution, 286.7 mg of pyridinium 2-[5-phenyl-2-{2-[5-phenyl-3-(2-sulfonatoethyl)-benzoxazolin-2-ylidenemethyl]-1-butenyl}-3-benzoxazolio]ethanesulfonate was added to the resulting mixture. After being kept at 52° C. for 15 minutes, the resulting mixture was desalted and washed with water. Further, 90.0 g of lime-processed gelatin was added thereto, and then triethylthiourea was added for optimum chemical sensitization. The silver chlorobromide emulsion (silver bromide: 40 mol%) thus obtained was called Emulsion (A-1).

Another emulsion was prepared in the same manner as in the preparation of Emulsion (A-1), except that 2.0 mg of potassium hexacyano-ferrate(II).trihydrate was added to the second aqueous alkali halide solution. The emulsion prepared in this manner was called Emulsion (A-2).

Another emulsion was prepared as follows. 6.4 g of sodium chloride was added to an aqueous 3 wt % solution of lime-processed gelatin and 3.2 ml of N,N'-dimethylimidazolidine-2-thione (aqueous 1 wt % solution) was added thereto. An aqueous solution containing 0.2 mol of silver nitrate and a first aqueous alkali halide solution containing 0.04 mol of potassium bromide and 0.16 mol of sodium chloride were added to the resulting solution with vigorous stirring at 52° C. and then blended. Subsequently, an aqueous solution containing 0.8 mol of silver nitrate and a second aqueous alkali halide solution containing 0.16 mol of potassium bromide and 0.64 mol of sodium chloride were further added thereto also with vigorous stirring at 52° C. and then blended. One minute after the completion of the addition of the aqueous silver nitrate solution and the second aqueous alkali halide solution, 286.7 mg of pyridinium 2-[5-phenyl-2-{2-[5-phenyl-3-(2-sulfonatoethyl)-benzoaxolin-2-ylidenemethyl]-1-butenyl}-3-benzoxazolio]-ethanesulfonate was added to the resulting mixture. After being kept at 52° C. for 15 minutes, the resulting mixture was desalted and washed with water. Further, 90.0 g of lime-processed gelatin was added thereto, and then triethylthiourea was added for optimum chemical sensitization. The silver chlorobromide emulsion (silver bromide: 20 mol %) thus obtained was called Emulsion (B-1).

Another emulsion was prepared in the same manner as in the preparation of Emulsion (B-1), except that 2.0 ml of potassium hexacyanoferrate(II).trihydrate was added to the second aqueous alkali halide solution. The emulsion prepared in this manner was called Emulsion (B-2).

Still another emulsion was prepared as follows. 3.3 g of sodium chloride was added to an aqueous 3 wt % solution of lime-processed gelatin, and 3.2 ml of N,N'-dimethylimidazolidine-2-thione (aqueous 1 wt % solution) was added thereto. An aqueous solution containing 0.2 mol of silver nitrate and a first aqueous alkali halide solution containing 0.2 mol of sodium chloride were added to the resulting solution with vigorous stirring at 52° C. and then blended. Subsequently, an aqueous solution containing 0.55 mol of silver nitrate and a second aqueous alkali halide solution containing 0.55 mol of sodium chloride were further added thereto also with vigorous stirring at 52° C. and blended. Additionally, an aqueous solution containing 0.25 mol of silver nitrate and a third aqueous alkali halide solution containing 0.2 mol of potassium bromide and 0.05 mol of sodium chloride were still further added thereto also with vigorous stirring at 52° C. One minute after the addition of the aqueous silver nitrate solution and aqueous alkali halide solution, 286.7 mg of pyridinium 2-[5-phenyl-2-{2-[5-phenyl-3-(2-sulfonatoethyl)benzoxazolin-2-ylidenemethyl]-1-butenyl}-3-benzoxazolio]ethanesulfonate was added to the resulting mixture. After being kept at 52° C. for 15 minutes, the resulting mixture was desalted and washed with water. Further, 90.0 g of lime-processed gelatin was added thereto, and triethylthiourea was added for optimum chemical sensitization. The silver bromochloride emulsion (silver bromide: 20 mol %) thus obtained was called Emulsion (C-1).

Another emulsion was prepared in the same manner as in the preparation of Emulsion (C-1), except that 2.0 mg of potassium hexacyanoferrate(II).trihydrate was added to the second aqueous alkali halide solution as added in the second time. The emulsion prepared in this manner was called Emulsion (C-2).

Still another emulsion was prepared also in the same manner as in the preparation of Emulsion (C-1), except that 0.91 mg of potassium hexachloroiridate(IV) was added to the third aqueous alkali halide solution. The emulsion prepared in this manner was called Emulsion (C-3).

A still further emulsion was prepared as follows. 3.3 g of sodium chloride was added to an aqueous 3 wt % solution of lime-processed gelatin, and 3.2 ml of N,N'-dimethylimidazolidine-2-thione (aqueous 1 wt % solution) was added thereto. An aqueous solution containing 0.2 mol of silver nitrate and a first aqueous alkali halide solution containing 0.004 mol of potassium bromide and 0.196 mol of sodium chloride was added to the resulting solution with vigorous stirring at 52° C. and then blended. Subsequently, an aqueous solution containing 0.8 mol of silver nitrate and a second aqueous alkali halide solution containing 0.016 mol of potassium bromide and 0.784 mol of sodium chloride were further added thereto also with vigorous stirring at 52° C. and then blended. One minute after the completion of the addition of the aqueous silver nitrate solution and the second aqueous alkali halide solution, 286.7 mg of pyridinium 2-[5-phenyl-2-{2-[5-phenyl-3-(2-sulfonatoethyl)-benzoxazolin-2-ylidenemethyl]-1-butenyl}-3-benzoxazolio]ethanesulfonate was added to the resulting mixture. After being kept at 52° C. for 15 minutes, the resulting mixture was desalted and washed with water. Further, 90.0 g of lime-processed gelatin was added thereto, and triethylthiourea was added for optimum chemical sensitization. The silver chlorobromide emulsion (silver bromide: 2 mol %) thus obtained was called Emulsion (D-1).

Another emulsion was prepared in the same manner as in the preparation of Emulsion (D-1), except that 2.0 mg of potassium hexacyanoferrate(II).trihydrate was added to the second aqueous alkali halide solution. The emulsion prepared in this manner was called Emulsion (D-2).

Still another emulsion was prepared as follows. 3.3 g of sodium chloride was added to an aqueous 3 wt % solution of lime-processed gelatin, and 3.2 ml of N,N'-dimethylimidazolidine-2-thione (aqueous 1 wt % solution) was added thereto. An aqueous solution containing 0.2 mol of silver nitrate and a first aqueous alkali halide solution containing 0.2 mol of sodium chloride were added to the resulting solution with vigorous stirring and then blended. Subsequently, an aqueous solution containing 0.775 mol of silver nitrate and a second aqueous solution containing 0.775 mol of sodium chloride were further added thereto also with vigorous stirring at 52° C. and then blended. One minute after the completion of the addition of the aqueous silver nitrate solution and the second aqueous alkali halide solution, 286.7 mg of pyridinium 2-[5-phenyl-2-{2-[5-phenyl-3-(2-sulfonatoethyl)benzoxazolin-2-ylidenemethyl]-1-butenyl}-3-benzoxazolio]ethanesulfonate was added to the resulting mixture. After being kept at 52° C. for 15 minutes, an aqueous solution containing 0.025 mol of silver nitrate and a third aqueous solution containing 0.02 mol of potassium bromide and 0.005 mol of sodium chloride were further added thereto also with vigorous stirring at 40° C. and blended. Afterwards, the resulting mixture was desalted and washed with water. Further, 90.0 g of lime-processed gelatin was added thereto, and triethylthiourea was added for optimum chemical sensitization. The silver chlorobromide emulsion (silver bromide: 2 mol %) thus obtained was called Emulsion (E-1).

Another emulsion was prepared in the same manner as in the preparation of Emulsion (E-1), except that 2.0 mg of potassium hexacyanoferrate(II).trihydrate was added to the second aqueous alkali halide solution. The emulsion prepared in this manner was called Emulsion (E-2).

Still another emulsion was prepared in the same manner as in the preparation of Emulsion (E-2), except that 0.91 mg of potassium hexachloroiridate(IV) was added to the third aqueous alkali halide solution. The emulsion prepared in this manner was called Emulsion (E-3).

For these twelve kinds of Silver Halide Emulsions (A-1) through (E-3) thus prepared, the shape of the grains as well as the grain size and grain size distribution thereof were obtained from the respective microphotographs. It has been found that the silver halide grains contained in all the Emulsions (A-1) through (E-3) were cubic. The grain size was represented by the mean value of the diameter of a circle corresponding to the projected area of each grain; and the grain size distribution was represented by the value of the standard deviation of the grain size as divided by the mean grain size. The results thus obtained are shown in Table 1 below.

Next, the halogen composition of the emulsion grains was determined by measuring the X-ray diffraction from the silver halide crystals. For this, a monocolored CuKα ray was used as the light source, and the angle of diffraction was measured in detail from the line diffracted from the (200) plane of the grain crystal. The line diffracted from a crystal with a uniform halogen composition gives a single peak, while that from a crystal having localized phase with different compositions gives plural peaks corresponding to the respective compositions. From the angle of diffraction of the peak thus measured, the lattice constant was calculated out, whereby the halogen composition of the silver halide constituting the crystal may be determined. The results obtained are shown in Table 2 below.

TABLE 1

| Emulsion | Shape | Grain Size (Distribution) |
|---|---|---|
| A-1 | Cubic | 0.49 μm (0.09) |
| A-2 | " | 0.49 μm (0.09) |
| B-1 | " | 0.51 μm (0.08) |
| B-2 | " | 0.51 μm (0.08) |
| C-1 | " | 0.51 μm (0.09) |
| C-2 | " | 0.51 μm (0.09) |
| C-3 | " | 0.51 μm (0.09) |
| D-1 | " | 0.50 μm (0.07) |
| D-2 | " | 0.50 μm (0.07) |
| E-1 | " | 0.50 μm (0.08) |
| E-2 | " | 0.50 μm (0.08) |
| E-3 | " | 0.50 μm (0.08) |

TABLE 2

| Emulsion | Main Peak (%) | Side Peak (%) | Silver Bromide Localized Phase | Polyvalent Metal Ion Impurity |
|---|---|---|---|---|
| A-1 | Cl 60 (Br 40) | — | No | — |
| A-2 | Cl 60 (Br 40) | — | No | Fe (II) |
| B-1 | Cl 80 (Br 20) | — | No | — |
| B-2 | Cl 80 (Br 20) | — | No | Fe (II) |
| C-1 | Cl 100 | Cl 34–90 | Yes | — |
| C-2 | Cl 100 | Cl 34–90 | Yes | Fe (II) |
| C-3 | Cl 100 | Cl 34–90 | Yes | Fe (II), Ir (IV) |
| D-1 | Cl 98 (Br 2) | — | No | — |
| D-2 | Cl 98 (Br 2) | — | No | Fe (II) |
| E-1 | Cl 100 | Cl 61–90 | Yes | — |
| E-2 | Cl 100 | Cl 61–90 | Yes | Fe (II) |
| E-3 | Cl 100 | Cl 61–90 | Yes | Fe (II), Ir (IV) |

Next, 30.0 ml of ethyl acetate and 38.5 ml of Solvent (d) were added to 29.6 g of Magenta Coupler (a), 5.9 g of Color image Stabilizer (b) and 11.8 g of Color Image Stabilizer (c) and dissolved, and the resulting solution was dispersed by emulsification in 320 ml of an aqueous 10% gelatin solution containing 20 ml of 10% sodium dodecylbenzenesulfonate.

The emulsions previously obtained and the coupler-containing emulsified dispersion thus prepared were blended in the proportion as indicated in Table 3 below to obtain a coating composition for the first layer. This coating composition was coated on a paper support both surfaces of which were coated with polyethylene. Thus 12 kinds of photographic material samples were prepared, having the layer constitution as indicated in Table 3. As the gelatin hardening agent for each layer there was used 1-hydroxy-3,5-dichloro-s-triazine sodium salt.

TABLE 3

| Layer Constitution | |
|---|---|
| Second Layer: Protective Layer | |
| Gelatin | 1.50 g/m$^2$ |
| First Layer: Green-Sensitive Layer | |
| Silver Chloro(bromide) Emulsion (A-1) to (E-3) | 0.36 g/m$^2$ as Ag |
| Magenta Coupler (a) | 0.32 g/m$^2$ |
| Color Image Stabilizer (b) | 0.06 g/m$^2$ |
| Color Image Stabilizer (c) | 0.13 g/m$^2$ |
| Solvent (d) | 0.42 ml/m$^2$ |
| Gelatin | 1.00 g/m$^2$ |
| Support: | |
| Polyethylene-Coated Support (containing $TiO_2$ and ultramarine in the polyethylene layer which was on the same side of the support as the first layer) | |

The compounds used were as follows.

Magenta Coupler (a):

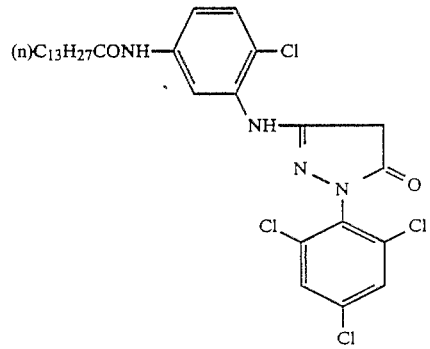

Color Image Stabilizer (b):

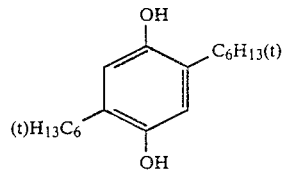

Color Image Stabilizer (c):

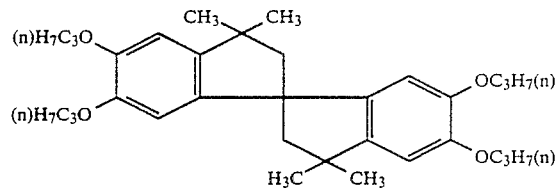

Solvent (d):

-continued

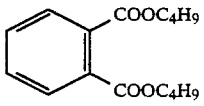

The coating composition contained the following compound in an amount of 125 mg per mol of the silver halide.

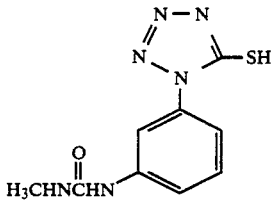

Using the thus prepared twelve kinds of coated samples (which were called in accordance with the code of the emulsion used), the properties of the respective samples were tested.

In order to know how the photographic characteristics of the respective samples would vary when the temperature thereof is varied during exposure, the samples were exposed at 15° C. or at 35° C. The exposure was effected through an optical wedge and a green filter for 0.1 second. The thus exposed samples were color-developed in accordance with the procedure mentioned below, using the developer also mentioned below.

The reflection density of each of the thus processed samples was measured, and a so-called characteristic curve was obtained therefrom for each sample. The sensitivity was the reciprocal of the exposure which gave a density higher than the fog density by 0.5. For comparison, the sensitivity of each sample was represented by the relative value to the sensitivity of Sample (A-1) (exposed at 15° C.) of being 100. The difference between the density corresponding to the exposure which was increased from the exposure for which the sensitivity was obtained, by 0.5 as log E, and the density of the point at which the sensitivity was obtained was calculated, which was the contrast value of each sample.

The results obtained are shown in Table 4 below.

The processing procedure comprised the following steps.

| Processing Step | Temperature (°C.) | Time (sec) |
|---|---|---|
| Color Development | 35 | 45 |
| Bleach Fixation | 30–35 | 45 |
| Rinsing (1) | 30–35 | 20 |
| Rinsing (2) | 30–35 | 20 |
| Rinsing (3) | 30–35 | 20 |
| Rinsing (4) | 30–35 | 30 |
| Drying | 70–80 | 60 |

(The rinsing was effected by a four tank cascade system from rinsing tank (4) to rinsing tank (1).)

The following solutions used in the respective processing steps were as follows.

Color Developer

| | |
|---|---|
| Water | 800 ml |
| Ethylenediamine-N,N,N,N-tetramethylphosphonic Acid | 1.5 g |
| Triethylenediamine(1,4-diazabicyclo-[2,2,2]octane) | 5.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| Brightening Agent (UVITEX CK, made by Ciba Geigy) | 2.0 g |
| Water to make | 1,000 ml |
| pH (25° C.) | 10.10 |

Bleach Fixer

| | |
|---|---|
| Water | 400 ml |
| Ammonium Thiosulfate (70 wt %) | 100 ml |
| Sodium Sulfite | 18 g |
| Ethylenediaminetetraacetic Acid/Iron(III) Ammonium Complex | 55 g |
| Ethylenediaminetetraacetic Acid Disodium Salt | 3 g |
| Ammonium Bromide | 40 g |
| Glacial Acetic Acid | 8 g |
| Water to make | 1,000 ml |
| pH (25° C.) | 5.5 |

Rinsing Solution

Ion-Exchanged Water (calcium and magnesium contents: each 3 ppm or less)

TABLE 4

| | Exposure at 15° C. | | Exposure at 35° C. | | |
|---|---|---|---|---|---|
| Sample | Relative Sensitivity | Contrast | Relative Sensitivity | Contrast | Note |
| A-1 | 100 | 0.58 | 102 | 0.59 | Comparison |
| A-2 | 115 | 0.60 | 116 | 0.61 | Comparison |
| B-1 | 53 | 1.07 | 68 | 1.09 | Comparison |
| B-2 | 64 | 1.19 | 77 | 1.22 | Comparison |
| C-1 | 107 | 1.20 | 123 | 1.24 | Comparison |
| C-2 | 122 | 1.36 | 124 | 1.37 | Invention |
| C-3 | 119 | 1.42 | 120 | 1.42 | Invention |
| D-1 | 37 | 1.01 | 58 | 1.13 | Comparison |
| D-2 | 45 | 1.14 | 63 | 1.28 | Comparison |
| E-1 | 108 | 1.13 | 138 | 1.29 | Comparison |
| E-2 | 136 | 1.39 | 138 | 1.40 | Invention |
| E-3 | 134 | 1.45 | 135 | 1.46 | Invention |

From the results in Table 4 above, the remarkable effect of the present invention can be seen. Precisely, in Samples (A-1) and (A-2) where an emulsion having a silver bromide content of 40 mol % was used, although the variation of the sensitivity was small when the temperature during exposure was varied, the contrast obtained by the processing time tested was extremely low. Accordingly, these samples cannot be put to practical use. In addition, the effect by the addition of the iron complex could not be seen in these samples.

On the other hand, in Samples (B-1) and (B-2) where an emulsion having a total silver chloride content of 80 mol % but not having a silver bromide-localized phase was used, although a high contrast could be obtained even by rapid processing, the sensitivity was low and therefore these samples are not practicable.

In Sample (C-1) where an emulsion having a silver bromide-localized phase was used but which did not contain iron ions, although a high sensitivity could be obtained, the sensitivity noticeably varied by variation of the temperature during exposure. Such a noticeable variation of sensitivity is a problem. On the other hand, in Sample (C-2) where the emulsion of the present invention was used, the sensitivity was high, the contrast was high, and the variation of the sensitivity was small when the temperature during exposure was varied. Accordingly, Sample (C-2) of the present invention was excellent for practical use. In addition, in Sample (C-3) where an Ir compound-containing and Fe ion-containing emulsion was used, the photographic characteristics were noted to be even more excellent.

The effect of the present invention as mentioned above can be noted even more clearly by comparing Samples (D-1) through (E-3) where emulsions having a silver chloride content of 98 mol % or higher were used.

EXAMPLE 2

5.8 g of sodium chloride was added to an aqueous 3 wt % solution of lime-processed gelatin, and 3.8 ml of N,N'-dimethylimidazolidine-2-thione (aqueous wt % solution) was added thereto. An aqueous solution containing 0.04 mol of silver nitrate and a first aqueous alkali halide solution containing 0.016 mol of potassium bromide and 0.024 mol of sodium chloride were added to the resulting solution with vigorous stirring at 75° C. and blended. Subsequently, an aqueous solution containing 0.96 mol of silver nitrate and a second aqueous alkali halide solution containing 0.384 mol of potassium bromide and 0.576 mol of sodium chloride were added thereto with also vigorous stirring at 75° C. and blended. One minute after the addition of the aqueous silver nitrate solution and the second aqueous alkali halide solution, 172.8 mg of triethylammonium 3-{2-[5-chloro-3-(3-sulfonatopropyl)benzothiazolin-2-ylidenemethyl]-3-naphtho[1,2-d]thiazolio}propanesulfonate was added to the resulting mixture. After being kept at 75° C. for 15 minutes, the resulting mixture was desalted and washed with water. Further, 90.0 g of lime-processed gelatin was added thereto and then triethylthiourea was added for optimum chemical sensitization to obtain a surface latent image type emulsion. The thus obtained silver chlorobromide emulsion (silver bromide: 40 mol %) was called Emulsion (F-1).

Another emulsion was prepared in the same manner as in the preparation of Emulsion (F-1), except that 0.5 mg of potassium hexacyanoferrate(II).trihydrate was added to the second aqueous alkali halide solution. The emulsion prepared in this manner was called Emulsion (F-2).

Another emulsion was prepared as follows. 5.8 g of sodium chloride was added to an aqueous 3 wt % solution of lime-processed gelatin, and 3.8 ml of N,N'-dimethylimidazolidine-2-thione (aqueous 1 wt % solution) was added thereto. An aqueous solution containing 0.04 mol of silver nitrate and a first aqueous alkali halide solution containing 0.0008 mol of potassium bromide and 0.0392 mol of sodium chloride were added to the resulting solution with vigorous stirring at 75° C. and blended. Subsequently, an aqueous solution containing 0.96 mol of silver nitrate and a second aqueous alkali halide solution containing 0.0192 mol of potassium bromide and 0.9408 mol of sodium chloride were further added thereto also with vigorous stirring at 75° C. and blended. One minute after the completion of the addition of the aqueous silver nitrate solution and the second aqueous alkali halide solution, 172.8 mg of triethylammonium 3-{2-[5-chloro-3-(3-sulfonatopropyl)benzothiazolin-2-ylidenemethyl]-3-naphtho[1,2-d]thiazolio}propanesulfonate was added to the mixture. After being kept at 75° C. for 15 minutes, the resulting mixture was desalted and washed with water. Further, 90.0 g of lime-processed gelatin was added thereto and then triethylthiourea was added for optimum chemical sensitization to obtain a surface latent image type emulsion. The thus obtained silver chlorobromide emulsion (silver bromide: 2 mol %) was called Emulsion (G-1).

Another emulsion was prepared in the same manner as in the preparation of Emulsion (G-1), except that 0.5 mg of potassium hexacyanoferrate(II).trihydrate was added to the second aqueous alkali halide solution. The emulsion prepared in this manner was called Emulsion (G-2).

Still another emulsion was prepared as follows. 5.8 g of sodium chloride was added to an aqueous 3 wt% solution of lime-processed gelatin, and 3.8 ml of N,N'-dimethylimidazolidine-2-thione (aqueous 1 wt % solution) was added thereto. An aqueous solution containing 0.04 mol of silver nitrate and a first aqueous alkali halide solution containing 0.04 mol of sodium chloride were added to the resulting solution with vigorous stirring at 75° C. are blended. Subsequently, an aqueous solution containing 0.935 mol of silver nitrate and a second aqueous alkali halide solution containing 0.935 mol of sodium chloride were further added thereto also with vigorous stirring at 75° C. and blended. One minute after the completion of the addition of the aqueous silver nitrate solution and the second aqueous alkali halide solution, 172.8 mg of triethylammonium 3-{2-[5-chloro-3-(3-sulfonatopropyl)benzothiazolin-2-ylidenemethyl]-3-naphtho[1,2-d]thiazolio}propanesulfonate was added to the resulting mixture. After being kept at 75° C. for 15 minutes, an aqueous solution containing 0.025 mol of silver nitrate and a third aqueous alkali halide solution containing 0.02 mol of potassium bromide and 0.005 mol of sodium chloride were added thereto with vigorous stirring at 40° C. and blended. Afterwards, the resulting mixture was desalted and washed with water. Further, 90.0 g of lime-processed gelatin was added thereto and triethylthiourea was added for optimum chemical sensitization to obtain a surface latent image type emulsion. The thus obtained silver chlorobromide emulsion (silver bromide: 2 mol %) was called Emulsion (H-1).

Another emulsion was prepared in the same manner as in the preparation of Emulsion (H-1), except that 0.5 mg of potassium hexacyanoferrate(III).trihydrate was added to the second aqueous alkali halide solution. The emulsion prepared in this manner was called Emulsion (H-2).

Still another emulsion was prepared also in the same manner as in the preparation of Emulsion (H-2), except that 0.12 mg of potassium hexachloroiridate(IV) was added to the third aqueous alkali halide solution. The emulsion prepared in this manner was walled Emulsion (H-3).

In addition, Emulsions (I-1), (I-2), (J-1), (J-2), (K-1), (K-2) and (K-3) were prepared in the same manner as in the preparation of Emulsions (A-1), (A-2), (D-1), (D-2), (E-1), (E-2) and (E-3) in Example 1, respectively, except that 60.0 mg of 2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide was added in place of 286.7 mg of pyridinium 2-[5-phenyl-2-{2-[5-phenyl-3-(2-sulfonatoethyl)benzoxazolin-2-ylidenemethyl]-1-butenyl}-3-benzoxazolio]ethanesulfonate.

Among the thus prepared emulsions, Emulsions (F-1), (F-2), (G-1), (G-2), (H-1), (H-2}and (H-3) were measured with respect to the shape of the grains as well as the grain size and the grain size distribution thereof. The results obtained are shown in Table 5 below.

In addition, the halogen composition of the emulsion grains was also obtained by X-ray diffraction in the same manner as in Example 1, and the results obtained are shown in Table 6 below.

TABLE 5

| Emulsion | Shape | Grain Size (Distribution) |
|---|---|---|
| F-1 | Cubic | 1.01 μm (0.08) |
| F-2 | " | 1.01 μm (0.08) |
| G-1 | " | 1.03 μm (0.07) |
| G-2 | " | 1.03 μm (0.07) |
| H-1 | " | 1.03 μm (0.07) |
| H-2 | " | 1.03 μm (0.07) |
| H-3 | " | 1.03 μm (0.07) |

TABLE 6

| Emulsion | Main Peak (%) | Side Peak (%) | Silver Bromide Localized Phase | Polyvalent Metal Ion Impurity |
|---|---|---|---|---|
| F-1 | Cl 60 (Br 40) | — | No | — |
| F-2 | Cl 60 (Br 40) | — | No | Fe (II) |
| G-1 | Cl 98 (Br 2) | — | No | — |
| G-2 | Cl 98 (Br 2) | — | No | Fe (II) |
| H-1 | Cl 100 | Cl 53-90 | Yes | — |
| H-2 | Cl 100 | Cl 53-90 | Yes | Fe (II) |
| H-3 | Cl 100 | Cl 53-90 | Yes | Fe (II), Ir (IV) |

Using the thus obtained emulsions, seven kinds of multilayer color photographic material Samples (I) to (VII) were prepared. The composition of the respective layers, the layer constitution and the combination of the emulsions are indicated below. The coating composition were prepared as follows.

Preparation of Coating Composition for First Layer 27.2 ml of ethyl acetate and 7.9 ml of Solvent (d) were added to 19.1 g of Yellow Coupler (e) and 4.4 g of Color Image Stabilizer (f) and dissolved, and the resulting solution was dispersed by emulsification in an aqueous 10 wt % gelatin solution containing 8.0 ml of 10 wt % sodium dodecylbenzenesulfonate to obtain an emulsified dispersion.

In addition, the seven silver chlorobromide emulsions which are indicated in Table 7 for the blue-sensitive layer and the above previously prepared emulsified dispersion were blended and dissolved to obtain seven different coating compositions for the first layers (see below).

The other coating compositions for the second layers to the seventh layers were also prepared in the same manner as in the preparation of the coating compositions for the first layer, except that the emulsified dispersion in the coating composition for the fifth layer was used after removing ethyl acetate therefrom by distillation under reduced pressure at 40° C. after dispersion by emulsification.

The same compound as that used in Example 1 was used in each layer as gelatin hardening agent.

The couplers and other compounds used in Example 2 had the following structural formulae.

Yellow Coupler (e):

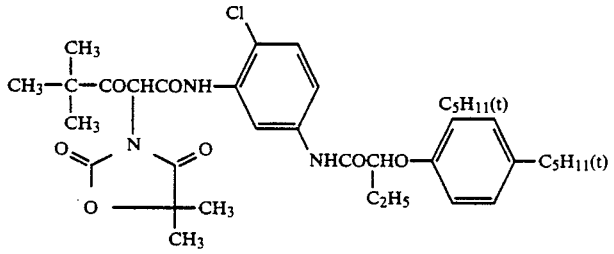

Color Image Stabilizer (f):

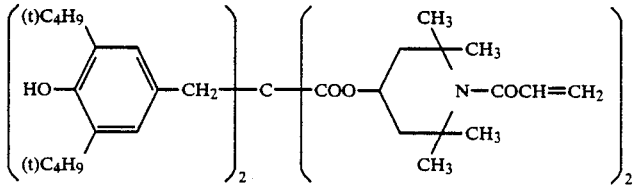

Color Mixing Preventing Agent (g):

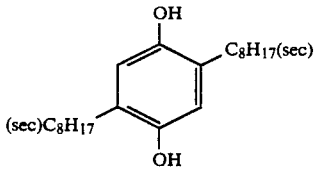

Magenta Coupler (h):

-continued
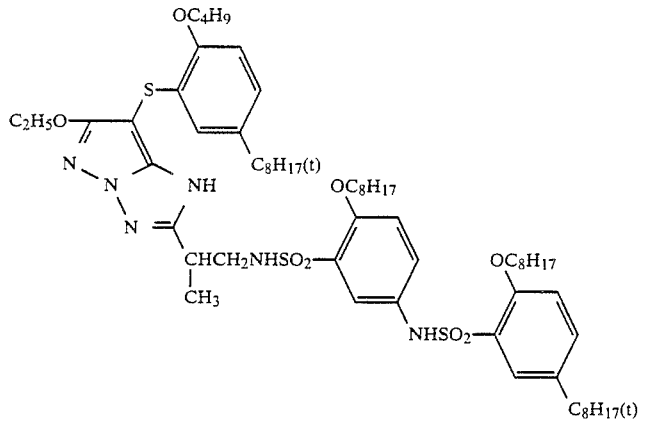
Solvent (i):
2/1 (by weight) mixture of the following compounds
$(C_8H_{17}O)_3P{=}O$ and (
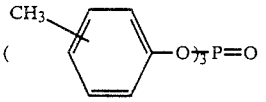
Ultraviolet Absorbent (j):
1/5/3 mixture (by mol) of the following compounds
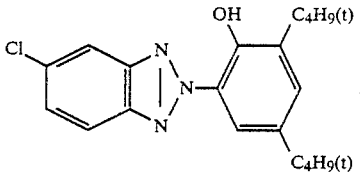
and
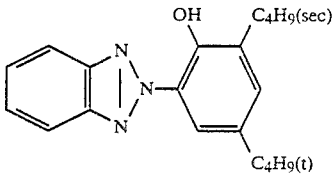
and
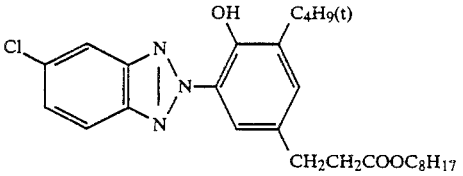
Color Mixing Preventing Agent (k):
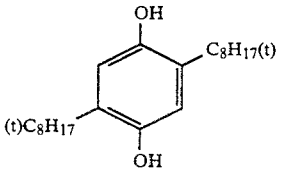
Solvent (l):
$(isoC_9H_{19}O)_3P{=}O$
Cyan Coupler (m):
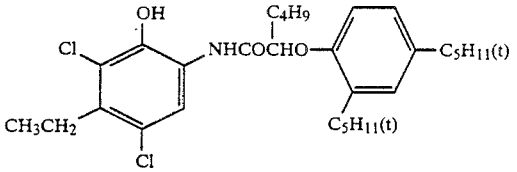
Color Image Stabilizer (n):
1/3/3 mixture (by mol) of the following compounds -continued

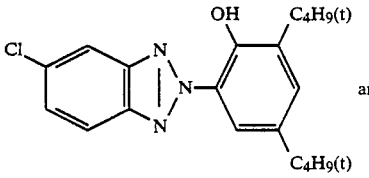

and

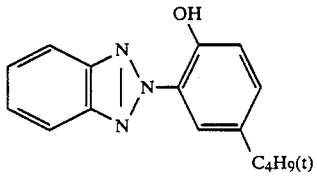

and

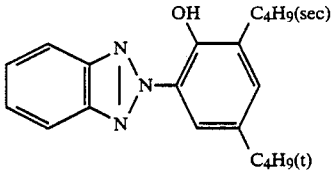

The following compounds were used as an antiirradiation dye for each layer.

Green-sensitive Emulsion Layer:

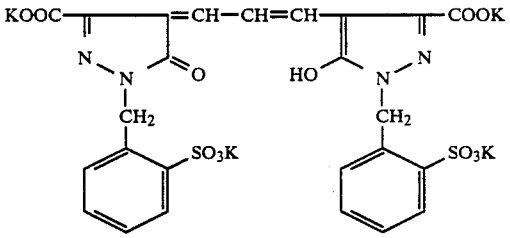

Red-sensitive Emulsion Layer:

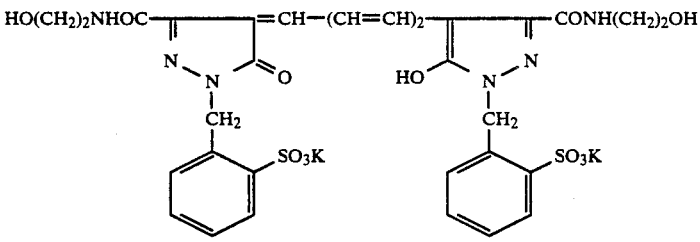

In addition, the following compound was added in an amount of 50 mg per mol of silver halide to the coating composition for the blue-sensitive emulsion layer and in an amount of 125 mg per mol of silver halide to each of the coating compositions for the green-sensitive emulsion layer and the red-sensitive emulsion layer.

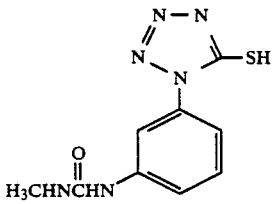

Layer Constitution

The layer constitution of the seven Samples (I) to (VII) was as follows. The amount of silver halide was represented by the weight of silver coated.

Support

Polyethylene-laminated paper comprised of a paper support both surfaces of which were coated with polyethylene (containing $TiO_2$ and ultramarine in the polyethylene layer which was on the same side of the support as the first layer)

| | |
|---|---|
| First Layer: Blue-Sensitive Layer | |
| Silver Halide Emulsion (see Table 7) | 0.27 g/m$^2$ |
| Gelatin | 1.86 g/m$^2$ |
| Yellow Coupler (e) | 0.74 g/m$^2$ |
| Color Image Stabilizer (f) | 0.17 g/m$^2$ |
| Solvent (d) | 0.31 ml/m$^2$ |
| Second Layer: Color Mixing Preventing Layer | |
| Gelatin | 0.99 g/m$^2$ |
| Color Mixing Preventing Agent (g) | 0.08 g/m$^2$ |
| Third Layer: Green-Sensitive Layer | |
| Silver Halide Emulsion (see Table 7) | 0.16 g/m$^2$ |
| Gelatin | 1.80 g/m$^2$ |
| Magenta Coupler (h) | 0.45 g/m$^2$ |
| Color Image Stabilizer (c) | 0.20 g/m$^2$ |
| Solvent (i) | 0.45 ml/m$^2$ |
| Fourth Layer: Ultraviolet Absorbing Layer | |
| Gelatin | 1.60 g/m$^2$ |
| Ultraviolet Absorbent (j) | 0.62 g/m$^2$ |
| Color Mixing Preventing Agent (k) | 0.05 g/m$^2$ |
| Solvent (l) | 0.26 ml/m$^2$ |
| Fifth Layer: Red-Sensitive Layer | |
| Silver Halide Emulsion (see Table 7) | 0.24 g/m$^2$ |
| Gelatin | 0.96 g/m$^2$ |
| Cyan Coupler (m) | 0.38 g/m$^2$ |
| Color Image Stabilizer (n) | 0.17 g/m$^2$ |
| Solvent (d) | 0.23 ml/m$^2$ |
| Sixth Layer: Ultraviolet Absorbing layer | |
| Gelatin | 0.54 g/m$^2$ |
| Ultraviolet Absorbent (j) | 0.21 g/m$^2$ |

-continued

| | |
|---|---|
| Solvent (I) | 0.09 ml/m$^2$ |
| Seventh Layer: Protective Layer | |
| Gelatin | 1.33 g/m$^2$ |
| Acryl-Modified Copolymer of Polyvinyl Alcohol (modification degree: 17%) | 0.17 g/m$^2$ |

TABLE 7

| Sample | Emulsion for Blue-Sensitive Layer | Emulsion for Green-Sensitive Layer | Emulsion for Red-Sensitive Layer |
|---|---|---|---|
| (I) | F-1 | A-1 | I-1 |
| (II) | F-2 | A-2 | I-2 |
| (III) | G-1 | D-1 | J-1 |
| (IV) | G-2 | D-2 | J-2 |
| (V) | H-1 | E-1 | K-1 |
| (VI) | H-2 | E-2 | K-2 |
| (VII) | H-3 | E-3 | K-3 |

The thus prepared Samples (I) to (VII) were tested with respect to the photographic properties thereof.

The samples were exposed and developed in the same manner as in Example 1, except that three kinds of filters comprising blue, green and red filters were used during the exposure. Thus samples monocolored in the respective light-sensitive layers were prepared. The reflection density of the thus colored samples was measured. The relative sensitivity and the contrast were investigated in both cases exposed at 15° C. and 35° C. The results obtained are shown in Table 8 below.

The relative sensitivity means a relative value to the sensitivity of Sample (I) exposed at 15° C. which was given a value of 100. (For comparison, the blue-sensitive layer of each sample was compared with the blue-sensitive layer of Sample (I). Similarly, the red-sensitive layer of Sample (I) and the green-sensitive layer of Sample (I) were used as the standard for determining the relative sensitivity of the red-sensitive layers and green-sensitive layers, respectively, of Samples (II) to (VII).) The difference in exposure for obtaining contrast was 0.4 as log E for the blue-sensitive layer.

TABLE 8

| Sample | Exposure at 15° C. Relative Sensitivity | Exposure at 15° C. Contrast | Exposure at 35° C. Relative Sensitivity | Exposure at 35° C. Contrast | Note |
|---|---|---|---|---|---|
| (I) Blue-Sensitive Layer | 100 | 0.42 | 103 | 0.43 | Comparison |
| Green-Sensitive Layer | 100 | 0.58 | 102 | 0.59 | |
| Red-Sensitive | 100 | 0.65 | 103 | 0.65 | |
| (II) Blue-Sensitive Layer | 112 | 0.45 | 115 | 0.46 | Comparison |
| Green-Sensitive Layer | 115 | 0.60 | 116 | 0.61 | |
| Red-Sensitive Layer | 117 | 0.66 | 119 | 0.67 | |
| (III) Blue-Sensitive Layer | 41 | 0.87 | 65 | 0.89 | Comparison |
| Green-Sensitive Layer | 37 | 1.01 | 58 | 1.13 | |
| Red-Sensitive Layer | 28 | 1.09 | 50 | 1.18 | |
| (IV) Blue-Sensitive Layer | 51 | 0.89 | 60 | 0.90 | Comparison |
| Green-Sensitive Layer | 45 | 1.14 | 63 | 1.28 | |
| Red-Sensitive Layer | 39 | 1.19 | 59 | 1.31 | |
| (V) Blue-Sensitive Layer | 112 | 0.86 | 143 | 0.86 | Comparison |
| Green-Sensitive Layer | 108 | 1.13 | 138 | 1.29 | |
| Red-Sensitive Layer | 99 | 1.17 | 125 | 1.32 | |
| (VI) Blue-Sensitive Layer | 134 | 0.99 | 137 | 1.01 | Invention |
| Green-Sensitive Layer | 136 | 1.39 | 138 | 1.40 | |
| Red-Sensitive Layer | 132 | 1.43 | 136 | 1.44 | |
| (VII) Blue-Sensitive Layer | 131 | 1.05 | 132 | 1.05 | Invention |
| Green-Sensitive Layer | 134 | 1.45 | 135 | 1.46 | |
| Red-Sensitive Layer | 130 | 1.48 | 131 | 1.48 | |

From the results in Table 8 above, the remarkable effect of the present invention can be seen also in multilayer color photographic materials. Precisely, in Samples (I) and (II) where an emulsion having silver bromide content of 40 mol % was used, although the sensitivity was relatively high and the variation of the sensitivity was small when the temperature during exposure was varied, the developing speed was low so that the contrast obtained was also low.

On the other hand, in Samples (III) and (IV) where a silver chlorobromide emulsion having a mean silver chloride content of 98 mol % was used, although the developing speed could somewhat be elevated, the sensitivity was low since these samples did not have a silver bromide-localized phase. Accordingly, these samples cannot be put to practical use. In Sample (V) where an emulsion having a silver bromide-localized was used, although the developing speed was high and the sensitivity was also high, the sensitivity noticeably varied by variation of the temperature during exposure. Accordingly, this sample also cannot be put to practical use.

Only in Samples (VI) and (VII) where the emulsion of the present invention was used, was the sensitivity high, the contrast high, and the variation of the sensitivity small when the temperature during exposure was varied. Accordingly, the color photographic material samples of the present invention were excellent for practical use.

EXAMPLE 3

Using Samples (I) to (VII) prepared in Example 2, the same test was conducted, except that the developing procedure and the processing solutions for the procedure were varied as follows.

From the results obtained by the test, the extremely good effects of the present invention were noticeable.

Processing steps in development were as follows.

| Processing Steps | Temperature (°C.) | Time (sec) |
|---|---|---|
| Color Development | 35 | 45 |
| Bleach Fixation | 30–36 | 45 |
| Stabilization (1) | 30–37 | 20 |
| Stabilization (2) | 30–37 | 20 |
| Stabilization (3) | 30–37 | 20 |
| Stabilization (4) | 30–37 | 30 |
| Drying | 70–85 | 60 |

(The stabilization was effected by a four tank cascade system from stabilization bath (4) to stabilization tank (1).)

The processing solutions used in the respective processing steps were as follows:

Color Developer

| | |
|---|---|
| Water | 800 ml |
| Ethylenediaminetetraacetic Acid | 2.0 g |
| Triethanolamine | 8.0 g |
| Sodium Chloride | 1.4 g |
| Potassium Carbonate | 25.0 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Brightening Agent (4,4'-diaminostilbene type) | 2.0 g |
| Water to make | 1,000 ml |
| pH | 10.10 |

Bleach Fixer

| | |
|---|---|
| Water | 400 ml |
| Ammonium Thiosulfate (70 wt %) | 100 ml |
| Sodium Sulfite | 18 g |
| Ethylenediaminetetraacetic Acid Iron(III) Ammonium Complex | 55 g |
| Ethylenediaminetetraacetic Acid Disodium Salt | 3 g |
| Glacial Acetic Acid | 8 g |
| Water to make | 1,000 ml |
| pH | 5.5 |

Stabilizer

| | |
|---|---|
| Formalin (37 wt %) | 0.1 g |
| Formalin-Sulfurous Acid Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1,000 ml |
| pH | 4.0 |

EXAMPLE 4

Ten kinds of multilayer color photographic material Samples (VIII) through (XVII) were prepared in the same manner as in Example 2, except that the compositions of the third layer and the fifth layer were varied as indicated in Table 9 below.

Samples (VIII) through (XVII) were tested in the same manner as in Example 2, and the effect of the present invention was ascertained.

From the results shown in Table 10 below, the effect attained by the use of the emulsion of the present invention (high sensitivity, high contrast and small sensitivity variation under temperature variation during exposure) was noticeably seen.

TABLE 9

| Layer | Composition | Amount Coated (VIII), (IX) | (X), (XI) | (XII), (XIII) | (XIV), (XV) | (XVI), (XVII) |
|---|---|---|---|---|---|---|
| 5th Layer (red-sensitive layer) | Silver Halide Emulsion (see Table 10) | 0.24 | 0.24 | 0.24 | 0.24 | 0.24 |
| | Gelatin | 0.96 | 0.96 | 0.96 | 1.60 | 1.60 |
| | Cyan Coupler | (s) 0.37 | (s) 0.37 | (s) 0.37 | (r) 0.35 | (r) 0.35 |
| | Color Image Stabilizer | (n) 0.17 | (n) 0.17 | (n) 0.17 | (n) 0.17 | (n) 0.17 |
| | Compound (t) | — | — | — | 0.35 | 0.35 |
| | Solvent | (w) 0.23 | (w) 0.23 | (w) 0.23 | (x) 0.23 | (x) 0.23 |
| 3rd Layer (green-sensitive layer) | Silver Halide Emulsion (see Table 10) | 0.36 | 0.20 | 0.16 | 0.36 | 0.16 |
| | Gelatin | 1.20 | 1.20 | 1.80 | 1.20 | 1.80 |
| | Magenta Coupler | (a) 0.32 | (o) 0.28 | (u) 0.35 | (a) 0.32 | (u) 0.35 |
| | Color Image Stabilizer | (b) 0.06 | (p) 0.06 | (c) 0.20 | (b) 0.06 | (c) 0.20 |
| | | (c) 0.13 | (c) 0.09 | | (c) 0.13 | |
| | Solvent | (v) 0.42 | (q) 0.42 | (i) 0.60 | (v) 0.42 | (i) 0.60 |

The additives used in Example 4 were the same as those in Examples 1 and 2, except for the following additives.

Magenta Coupler (o):

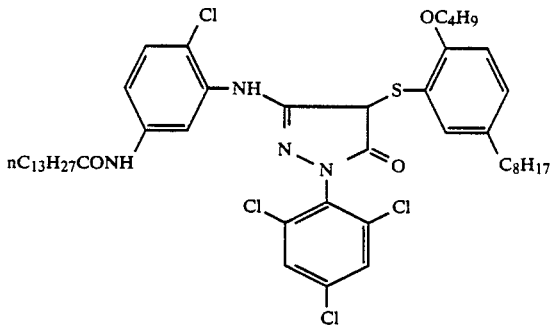

Color Image Stabilizer (p):

-continued
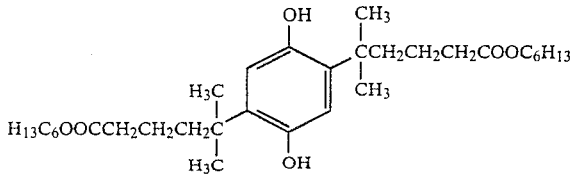
Solvent (q):
2/1/1 (by volume) mixture of the following compounds
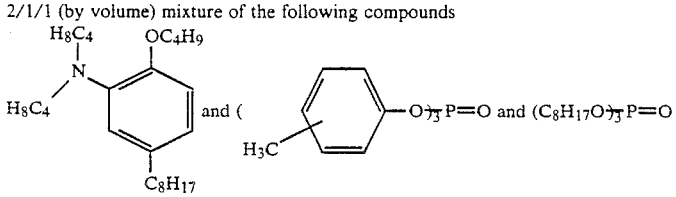
Cyan Coupler (r):
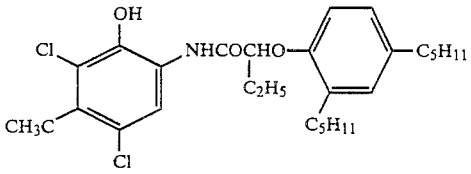
Cyan Coupler (s):
3/4 (by weight) mixture of the above cyan coupler (r) and the following compound
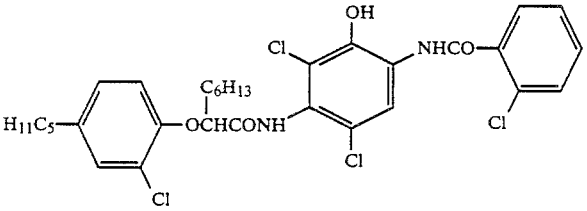
Compound (t):
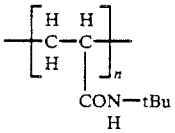
(number mean molecular weight: 60,000)
Magenta Coupler (u):
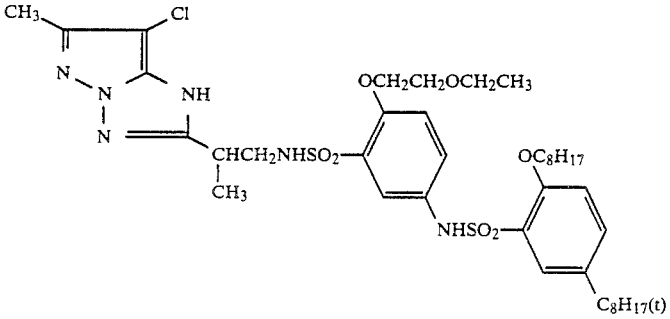
Solvent (v):
1/1 (by volume) mixture of the following compounds
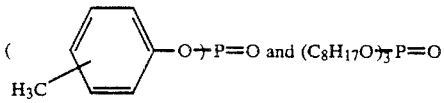
Solvent (w):
1/1 (by volume) mixture of the following compounds -continued

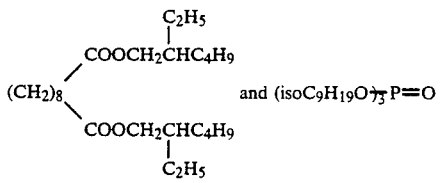

Solvent (x):

1/1/1 (by volume) mixture of the two compounds of solvent (w) and the following compound

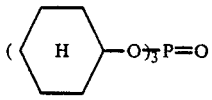

TABLE 10

| Sample | Emulsion for Blue-Sensitive Layer | Emulsion for Green-Sensitive Layer | Emulsion for Red-Sensitive Layer | Note |
|---|---|---|---|---|
| (VIII) | H-1 | E-1 | K-1 | Comparison |
| (IX) | H-3 | E-3 | K-3 | Invention |
| (X) | H-1 | E-1 | K-1 | Comparison |
| (XI) | H-3 | E-3 | K-3 | Invention |
| (XII) | H-1 | E-1 | K-1 | Comparison |
| (XIII) | H-3 | E-3 | K-3 | Invention |
| (XIV) | H-1 | E-1 | K-1 | Comparison |
| (XV) | H-3 | E-3 | K-3 | Invention |
| (XVI) | H-1 | E-1 | K-1 | Comparison |
| (XVII) | H-3 | E-3 | K-3 | Invention |

In accordance with the present invention, photographic materials having high sensitivity and high contrast can be obtained. The variation of the sensitivity of the material is small when the temperature during exposure varies. The photographic materials of the present invention are especially suitable to rapid color processing to be conducted in a substantially benzyl alcohol-free color developer for 2 minutes and 30 seconds or less.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one light-sensitive emulsion layer containing surface latent image type silver halide grains on a support, wherein said emulsion layer comprises a silver halide emulsion containing substantially silver iodide-free silver chlorobromide grains having a silver chloride content of 90 mol % or more, as a means value, and further having a silver bromide-localized phase with a silver bromide content of less than 70 mol % on the surface of said grains, and still further an effective amount of iron ion being incorporated in the inside or surface of said grains.

2. A silver halide photographic material as claimed in claim 1, wherein the iron ion is obtained from an iron ion donating compound which is a water-soluble iron salt or iron complex salt.

3. A silver halide photographic material as claimed in claim 2, wherein the iron ion donating compound is selected from the group consisting of hexacyanoferrates(II), hexacyanoferrates(III), ferrous thiocyanates and ferric thiocyanates.

4. A silver halide photographic material as claimed in claim 1, wherein said emulsion layer contains said substantially silver iodide-free silver chlorobromide grains in an amount of 50% by weight or more of the total silver halide grains therein.

5. A silver halide photographic material as claimed in claim 2, wherein the amount of the iron ion donating compound is from $5\times10^{-9}$ to $1\times10^{-3}$ mol per mol of silver halide.

6. A silver halide photographic material as claimed in claim 5, wherein the amount of the iron ion-donating compound is from $1\times10^{-8}$ to $5\times10^{-4}$ mol per mol of silver halide.

7. A silver halide photographic material as claimed in claim 2, wherein a different metal ion or complex metal ion selected from Group VIII metals is present in the localized phase or in the remaining portion of the grains together with the iron ion donating compound.

8. A silver halide photographic material as claimed in claim 1, wherein the silver chloride content in the substantially silver iodide-free silver chlorobromide emulsion is at least 95 mol %.

9. A silver halide photographic material as claimed in claim 1, wherein the silver bromide content in the silver bromide-localized phase is from 20 to 60 mol %.

10. A silver halide photographic material as claimed in claim 1, wherein the silver bromide content in the silver bromide-localized phase is from 30 to 50 mol %.

11. A silver halide photographic material as claimed in claim 1, wherein the silver bromide-localized phase is deposited together with 50% of the total iridium in the material.

12. A silver halide photographic material as claimed in claim 1, which contains a mercaptotetrazole of the following formula (I), (II) or (III), in an amount of from $1\times10^{-5}$ to $5\times10^{-2}$ mol of silver halide:

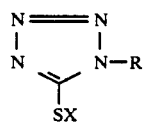

(I)

wherein R represents an alkyl group, an alkenyl group or an aryl group; and X represents a hydrogen atom, an alkali metal atom, an ammonium group or a precursor thereof;

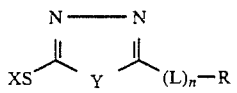

(II)

wherein Y represents an oxygen atom or a sulfur atom; L represents a divalent linking group; R represents a hydrogen atom, an alkyl group, an alkenyl group or an aryl group; n represents 0 or 1; and X has the same meaning as in formula (I);

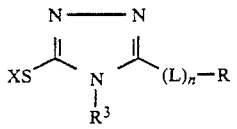

(III)

wherein R and X have the same meaning as in formula (I); L and n have the same meaning as in formula (II); $R^3$ has the same meaning as R, which may be the same as or different from the latter.

13. A silver halide photographic material as claimed in claim 12, wherein the mercaptotetrazole is present in an amount of from $1\times10^{-4}$ to $1\times10^{-2}$ mol.

14. A silver halide photographic material as claimed in claim 1, which has been spectrally sensitized with a cyanine dye of the general formula (IV):

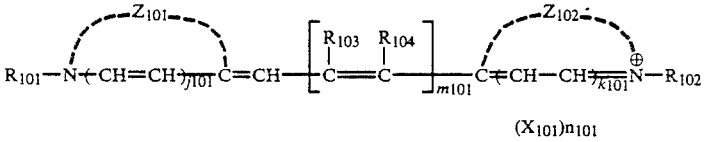

(IV)

wherein $Z_{101}$ and $Z_{102}$ each represents an atomic group necessary for forming a heterocyclic nucleus; $R_{101}$ and $R_{102}$ each represents an alkyl group, an alkenyl group, an alkynyl group or an aralkyl group; $m_{101}$ represents 0, or a positive integer of 1, 2 or 3; when $m_{101}$ is 1, $R_{103}$ represents a hydrogen atom, a lower alkyl group, an aralkyl group or an aryl group, and $R_{104}$ represents a hydrogen atom or forms a nitrogen atom-containing heterocyclic ring with $R_{102}$; when $m_{101}$ is 2 or 3, $R_{103}$ and $R_{104}$ each represents a hydrogen atom, a lower alkyl group or an aralkyl group, or $R_{103}$ forms a hydrocarbon ring or heterocyclic ring with another $R_{103}$ and $R_{104}$ represents a hydrogen atom, or alternatively $R_{104}$ forms a hydrocarbon ring or a heterocyclic ring with another $R_{104}$ and $R_{103}$ represents a hydrogen atom, or still alternatively $R_{104}$ may form a nitrogen atom-containing heterocyclic ring with $R_{102}$; $j_{101}$ and $k_{101}$ each represents 0 or 1; $X_{101}$ represents an acid anion; and $n_{101}$ represents 0 or 1.

15. A silver halide photographic material as claimed in claim 1, which further contains, together with one or more couplers, one or more compounds (A) capable of chemically bonding with the aromatic amine color developing agent which remains after color development to form a chemically inactive and substantially colorless compound and/or one or more compounds (B) capable of chemically bonding with the oxidation product of the aromatic amine color developing agent which remains after color development to form a chemically inactive and substantially colorless compound.

16. A silver halide photographic material as claimed in claim 15, wherein the compound (A) is selected from compounds of the general formula (AI) or (AII):

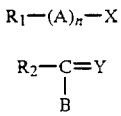

(AI)

(AII)

wherein $R_2$ and $R_2$ each represents an aliphatic group, an aromatic group or a heterocyclic group; n represents 0 or 1; A represents a group that can react with the aromatic amine developing agent to form a chemical bond; X represents a group that can react with the aromatic amine developing agent to split off; B represents a hydrogen atom, an aliphatic group, an aromatic group, a heterocyclic group, an acyl group or a sulfonyl group; Y represents a group that can facilitate the addition of the aromatic amine developing agent to the compound having formula (AII); and $R_1$ and X together or Y and $R_2$ or B together may combine to form a ring structure.

17. A silver halide photographic material as claimed in claim 1, wherein said silver halide emulsion containing substantially silver iodide-free silver chlorobromide grains is a monodispersed emulsion having a ratio of the statistical standard deviation to the mean grain size of 0.2 or less.

18. A silver halide photographic material as claimed in claim 17, wherein said silver halide emulsion is a monodispersed emulsion having a ratio of 0.15 or less.

19. A method of forming a color image which comprises developing an exposed silver halide photographic material having at least one light-sensitive emulsion layer containing surface latent image type silver halide grains on a support, wherein said emulsion layer comprises a silver halide emulsion containing substantially silver iodide-free silver chlorobromide grains having a silver chloride content of 90 mol % or more, as a mean value, and further having a silver bromide-localized phase with a silver bromide content of less than 70 mol % on the surface of said grains, and still further an effective amount of iron ion being incorporated in the inside or surface of said grains with a color developer substantially not containing benzyl alcohol for a period of time of 2 minutes and 30 seconds or less.

* * * * *